US005106133A

United States Patent [19]

Fukumoto et al.

[11] Patent Number: 5,106,133

[45] Date of Patent: Apr. 21, 1992

[54] POWER DOOR LOCK DEVICE WITH A SPRING RETRACTED GEAR WHEEL

[75] Inventors: Ryoichi Fukumoto, Nagoya; Shigeru Hayakawa, Chiryu; Nozomu Torii, Hekinan; Souichiro Okudaira, Toyota, all of Japan

[73] Assignee: Aisin Seiki Kabushiki Kaisha, Kariya, Japan

[21] Appl. No.: 640,589

[22] Filed: Jan. 14, 1991

Related U.S. Application Data

[63] Continuation of Ser. No. 382,753, Jul. 20, 1989, abandoned.

[30] Foreign Application Priority Data

Jul. 21, 1988 [JP] Japan ..... 63-182289
Jul. 21, 1988 [JP] Japan ..... 63-182292

[51] Int. Cl.[5] ..... E05C 3/26

[52] U.S. Cl. ..... 292/201; 292/337; 292/DIG. 23

[58] Field of Search ..... 292/216, 201, 337, 336.3, 292/DIG. 27, DIG. 23, 199, 142

[56] References Cited

U.S. PATENT DOCUMENTS 4,364,249 12/1982 Kleefeldt ..... 292/201 X
4,452,058 6/1984 Noel ..... 292/201 X
4,518,181 5/1985 Yamada ..... 292/201
4,518,182 5/1985 Cousin et al. ..... 292/201
4,624,491 11/1986 Vincent ..... 292/201
4,652,027 3/1987 Quantz ..... 292/201
4,664,430 5/1987 Bernard ..... 292/216 X
4,727,301 2/1988 Fulks et al. ..... 292/DIG. 23 X
4,735,447 4/1988 Kleefeldt ..... 292/216
4,904,006 2/1990 Hayakawa et al. ..... 292/DIG. 27
4,905,528 3/1990 Kanagucni et al. ..... 292/336.3
4,905,532 3/1990 Fukumoto et al. ..... 292/201

*Primary Examiner*—Eric K. Nicholson
*Attorney, Agent, or Firm*—Finnegan, Henderson, Farabow, Garrett and Dunner

[57] ABSTRACT

A power actuator for a door lock device comprising an electric motor driving a worm gear, a gear wheel driven by the worm gear, a handling lever driven by an arcuate projection on the gear wheel and a locking arm rotated by the handling lever. The wheel gear has a peripheral groove with a portion of reduced width for supporting opposite ends of an elongate coil spring; which is compressed in a direction corresponding to the rotation of the gear wheel. An arcuate segment projects axially from the gear wheel. The opposite ends of the arcuate segment and the handling lever is shaped to provide point contact with the handling lever upon initial engagement and surface contact as the arcuate projection moves the handling lever to the locking and unlocking position. A contact is disposed on a base plate; and contacts on the handling lever slidably engage the contacts on the base plate to detect the locking and unlocking position of the handling lever.

6 Claims, 32 Drawing Sheets

POWER DOOR LOCK DEVICE WITH A SPRING RETRACTED GEAR WHEEL

This application is a continuation of application Ser. No. 07/382,753, filed July 20, 1989, now abandoned.

BACKGROUND OF THE INVENTION

1. Field of the Invention

The present invention relates to a door lock device, and more particularly, to a door lock device capable of detecting whether or not a door is in the locked condition.

2. Description of the Prior Art

Conventionally, a check as to whether a door lock device is or is not in a locked condition is made when a vehicle begins to travel. That is to say, a locking arm for performing a locking operation and an unlocking operation is operatively connected to a handling lever which is rotated by a motor. A switch, disposed between the handling lever and a housing, is turned on after an angular rotation of the locking member.

However, since a door lock device is necessarily installed in a narrow space within a door, such disposal or arrangement of the switch, increases the thickness of the device and makes it cumbersome to install in the door.

SUMMARY OF THE INVENTION

It is, therefore, a primary object of the present invention to provide a door lock device without the aforementioned drawbacks.

Another object of the present invention is to provide a door lock device with less thickness than conventional ones.

To achieve the purpose of the present invention, a door lock device is comprised of a locking arm 9 for performing a locking operation and an unlocking operation, a handling lever 17 for driving the locking arm 9, an actuator means rotating the handling lever 17 through an angle, and a switch including a conductive portion 131 at a side of the conducting portion 131 slides.

To achieve the objects of the present invention, and in accordance with the broad purpose of the present invention, as embodied and broadly described herein, a power operated door lock device comprising a housing, a locking arm mounted to the housing and movable between a normal and a locking and unlocking position. An actuator assembly including a gear wheel assembly is mounted to the housing and has an arcuate groove extending through a predetermined angular segment of the wheel, an elongate coil spring is axially disposed in the groove and compressible in opposite directions in the groove. An abutment is disposed adjacent the periphery of the wheel having opposite ends defining a wheel segment. A pivotally mounted handling lever having an end portion engageable by opposite ends of the abutment for driving the locking arm selectively in opposite directions to the locking and unlocking position in response to a corresponding rotation of the wheel; and a drive means when energized is operative to rotate the gear wheel. Means responsive to the rotation of the gear which compress the elongate spring in a direction corresponding to the direction of rotation of the wheel for returning the wheel to the manual position upon deenergization of the drive means.

BRIEF DESCRIPTION OF THE DRAWINGS

FIG. 22(*b*) is a fragmentary perspective view of a switch means assembly of FIG. 17 mounted to the sub housing;

DESCRIPTION OF THE PREFERRED EMBODIMENT

Figure 1:
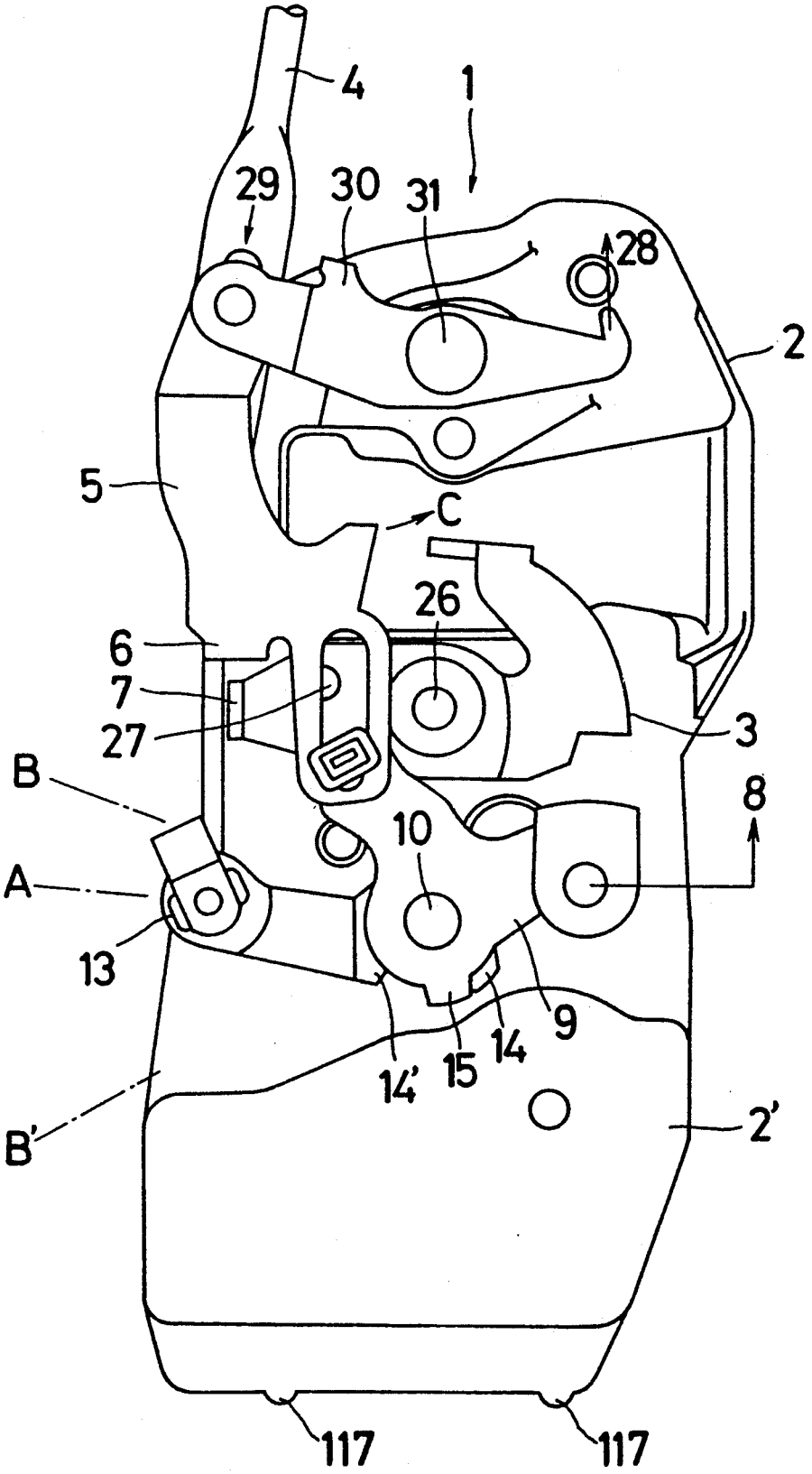
FIG. 1 is a front elevational view of a preferred embodiment of the present invention.
Figure 2:
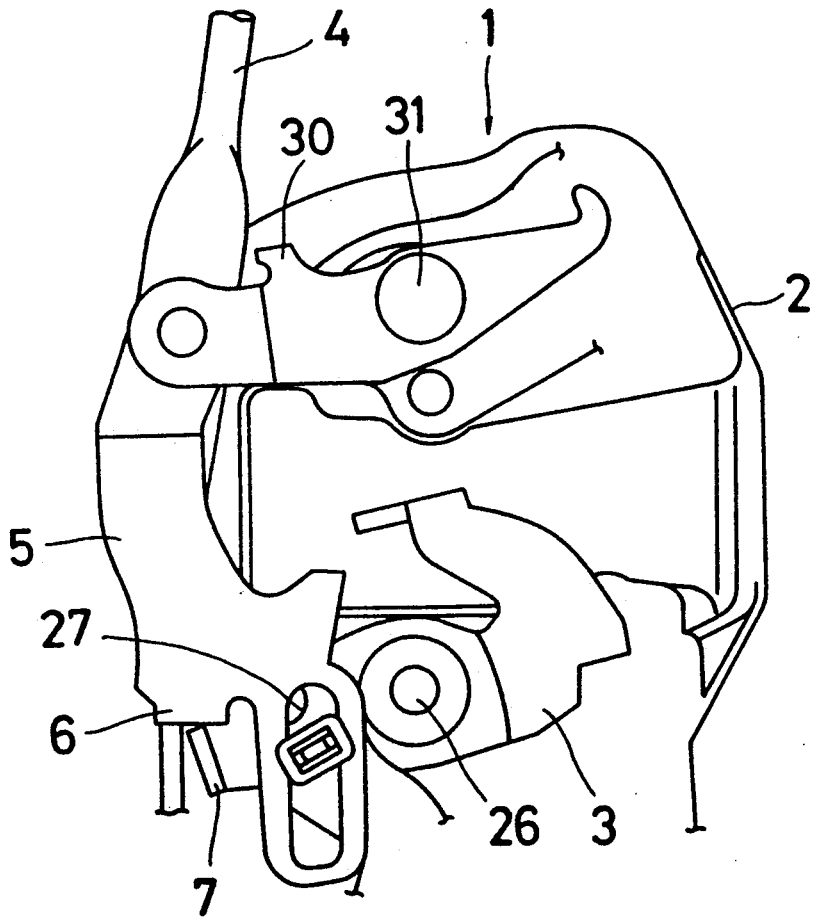
FIG. 2 is a fragmentary front view showing a state of operation of opening lever and a release lever.

The concept of the invention is exemplified in the preferred embodiment of a door lock device as explained hereinafter. A door lock device 1 has a substantially L-shaped release lever 3 fixed by a shaft to a main housing 2 made of synthetic resin. This release lever 3 can be turned pivotally about a central axis 26. Axis 26 is also a rotational center of a pawl for a door lock operation means having a ratchet and a pawl (not shown). Release lever 3 is connected to the pawl through a pin 27. In an open door state, a latch mounted to the door lock operation means coupled to a striker mounted to a vehicle (not shown) and said pawl are interlocked together. The position of the release lever 3 shown in FIG. 1 is in a locked condition wherein said latch of the door lock and the pawl are locked together. When the lever 3 is turned counterclockwise, the pawl turns the ratchet to effect a latch release state when the latch and the pawl are released it is possible to open the door. When an outside handle is manipulated, a force is applied in the direction shown by arrow 29, and a rod 4 turns a lever 30, fixed pivotally to the main housing 2, counterclockwise around a pivot axis 31. When an inside handle is manipulated, a force is applied in the direction of arrow 28, turning the lever 30 acted to the direction shown by 28, counterclockwise about the pivotal axis 31. Referring to FIG. 2, the turning of lever 30 counterclockwise causes an open lever 5, which is fixed pivotally at an end of said lever 30 to be pushed downwardly as viewed in FIG. 2. The downward movement of this open lever 5 causes a protrusion 6 at a central portion of the open lever 5 to push an end portion 7 of the release lever 3, and causing release lever 3 to turn counterclockwise around the pivotal axis 31, thus making it possible for the door lock to be in a latch released condition and the door is opened (Refer to FIG. 2).

Figure 4:
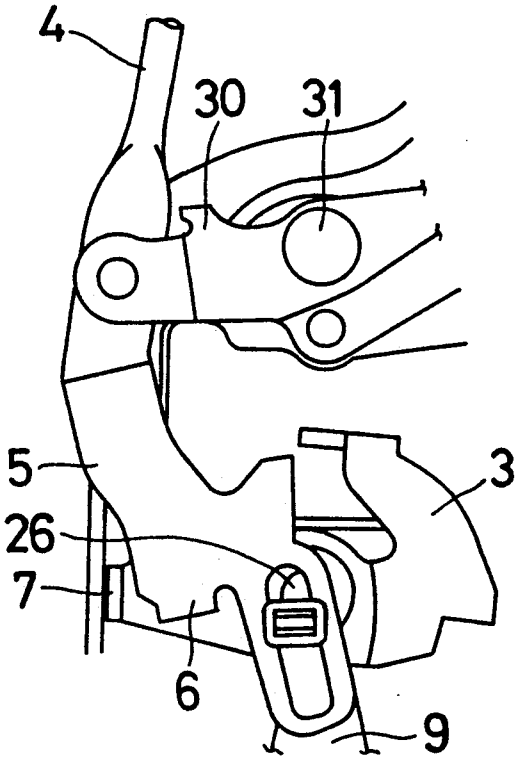
FIGS. 3 and 4 are fragmentary front views showing an unloaded oscillating state of a keyless locking mechanism.
Figure 3:
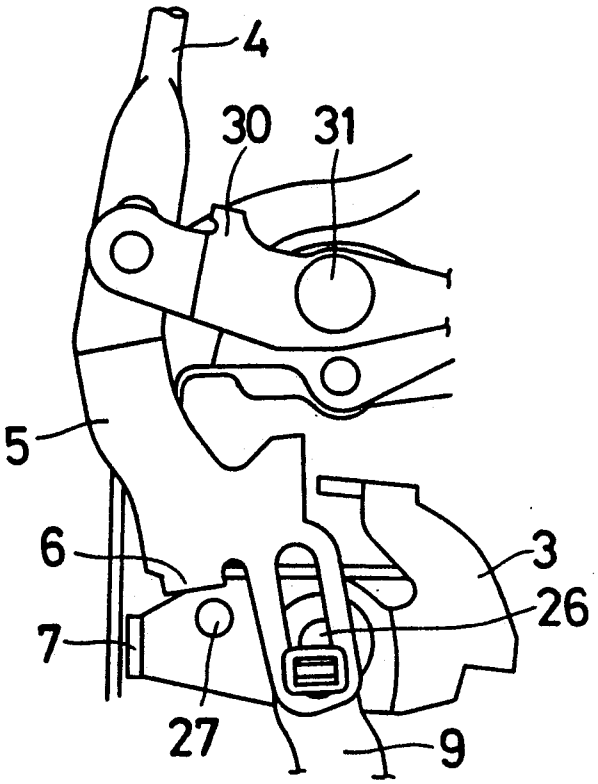

Though the door is locked to prevent the door from being opened by carelessness during the running of the vehicle, generally this door locking is carried out by pushing a locking button 8 which turns counterclockwise a locking arm 9 connected thereto. One part of the locking arm 9 is connected to the lower portion of open lever 5 through an elongated slot or hole. When locking arm 9 is located in the position of FIG. 1, a depressing of the open lever 5 causes protrusion 6 to abut an end portion 7 of the release lever. However, when the locking button 8 is pushed out and the locking arm 9 is turned clockwise together with a pin 10 (FIG. 1), the open lever 5 is moved around pin 10 in the direction of arrow C (FIG. 1), and said protrusion 6 is released from the end portion 7 of the release lever 3 as shown in FIG. 3. As a result, even if the handle is operated and the open lever 5 is moved downwardly, it moves idly without protrusion 6 abutting end portion 7, so that the lock remains in the locked condition as shown in FIG. 4.

Figure 6:
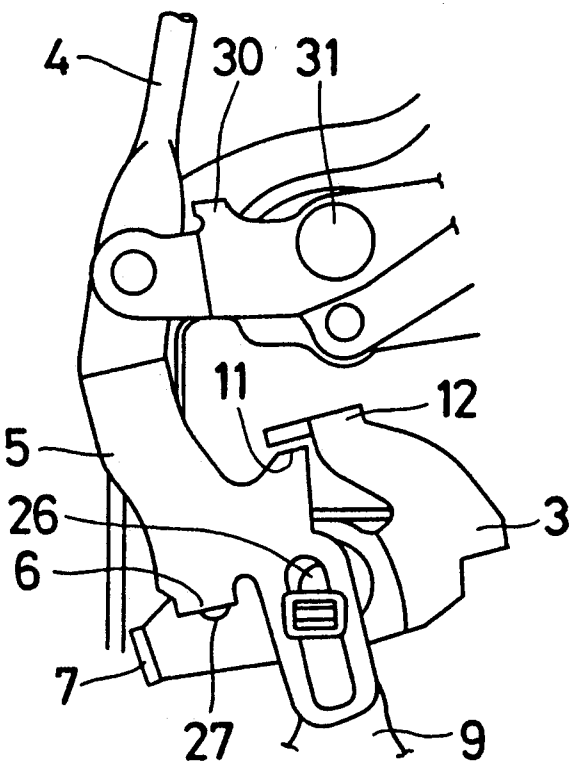
FIGS. 5 and 6 are additional fragmentary front views showing the keyless lock mechanism, in different operational states.
Figure 5:
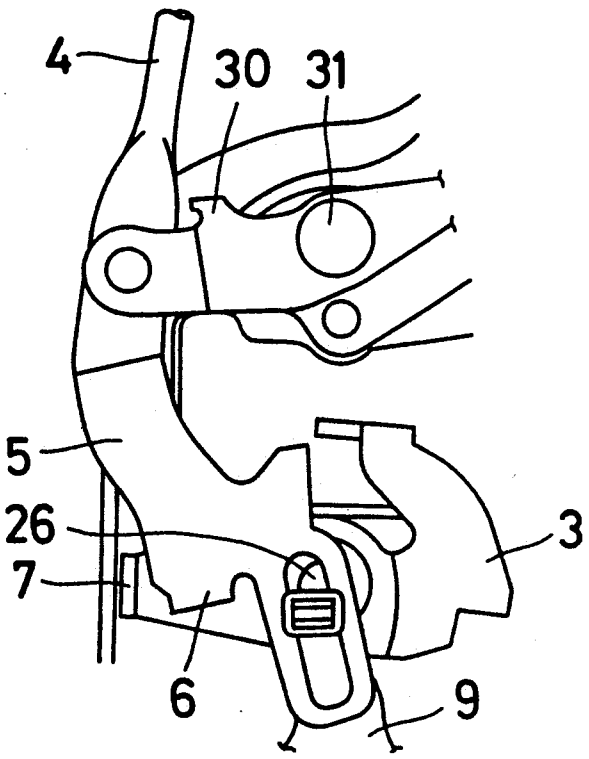

Next, a key lock mechanism for the door lock device will be described. With the door held open, and the locking button 8 is pushed, the locking arm 9 pivots clockwise, and protrusion 6 moved out of opposition relationship with end portion 7 of the release lever 3. Operation of outside- or inside-handle pushes the open lever 5 downwardly and it attains the position in FIG. 5. When the door is closed within this state, release lever 3 is turned counterclockwise, but a stepped portion 11 of the open lever 5 and the protrusion 12 of the release lever 3 are positioned relative to one another so that the release lever 3 freely and idly turns counterclockwise, so that the door lock is maintained as in FIG. 6. After the door is closed, a spring of the door lock operation means causes release lever 3 to attain the position of FIG. 5. When the operation of the handle stops, members 4 and 5 return to the state of FIG. 3.

Figure 7:
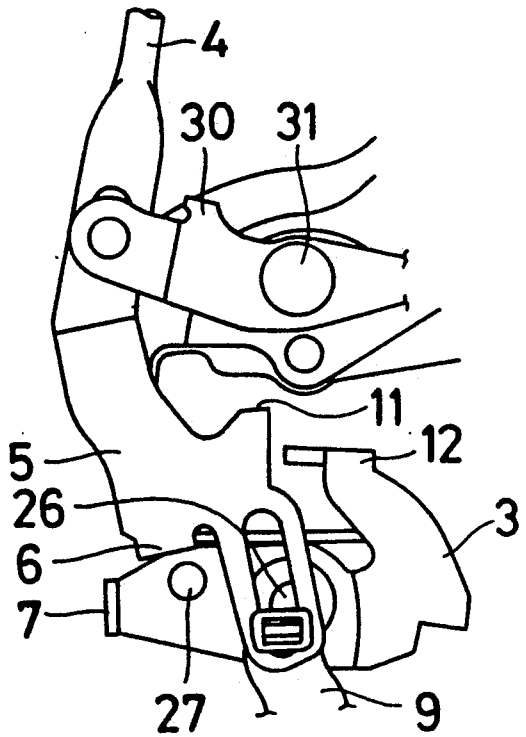

Next, the door lock of the present invention will be described with regard to the self cancelling mechanism. While the door is kept open, and the locking button 8 is pushed, then the locking arm 9 turns clockwise, and the open lever 5 is turned in C direction shown in FIG. 1, it is operated to the state of FIG. 7. When the door is closed without operating the outside- or inside-handle, the release lever 3 is turned counterclockwise by the pawl of the door lock operating or means (not shown).

Figure 8:
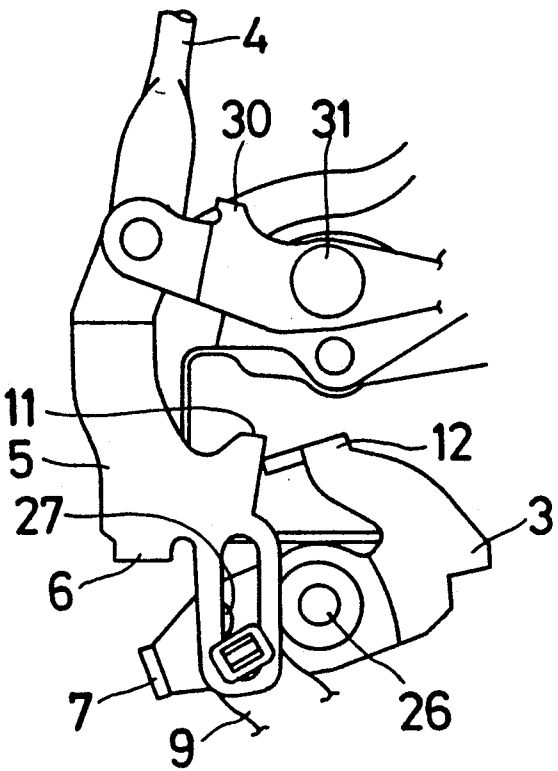
FIGS. 7 and 8 are additional fragmentary front views showing the keyless locking mechanism in a self cancelling state.

This movement causes the protrusion 12 of the release lever 3 to abut stepped portion 11 of the open lever 5, which pivots the open lever 5 clockwise as shown in FIG. 8. As a result, the locking button 8 is returned to the original position, and the locking arm 9 pivots counterclockwise around the pin 10 through the elongated hole of the open lever 5. In other words, since the mechanism is returned to the state shown in FIG. 1, when the handle is operated for opening the door, the protrusion 6 of the open lever 5 pushes on the end portion 7 of the release lever 3, to bring release lever 3 to an unlocked condition making it possible to open the door.

With reference to FIG. 1, the key operations will be described hereinafter. A key handling lever 13 is rotatably mounted to sub-housing housing 2'. Its protrusion means 14 is arranged next to a protrusion means 15 of the locking arm 9. Lever 13 is connected at one end to a key cylinder through the protrusion means 15. When a key is operated in the latch locking direction, the key handling lever 13 is turned clockwise from A to B position, and the locking arm 9 is turned clockwise by an abutment of the protrusion means 14 and the protrusion means 15, ensuring a locking condition of the door lock. When the turning of the key is stopped, the key handling lever 13 is returned from B to A position by the operation of a spring mounted adjacent the key cylinder side. Therefore, even in the state where the locking button 8 is pushed downwardly, the protrusion 6 of the open lever 5 and the end portion 7 of the release lever 3 do not face or oppose each other, and upon manipulation of outside- or inside-handle, the door remains as it was in the closed state. When the key is turned in a latch releasing direction, a stepped portion 14' pushes the protrusion means 15, turning the locking arm 9 counterclockwise, causing it to assume an unlocked state as shown in FIG. 1. Further, in the state of FIG. 1, even if the key handling lever 13 is turned to a B' position by the key, only the stepped portion 14' approaches the protrusion means 15, and the locking arm 9, is not turned.

Figure 9:
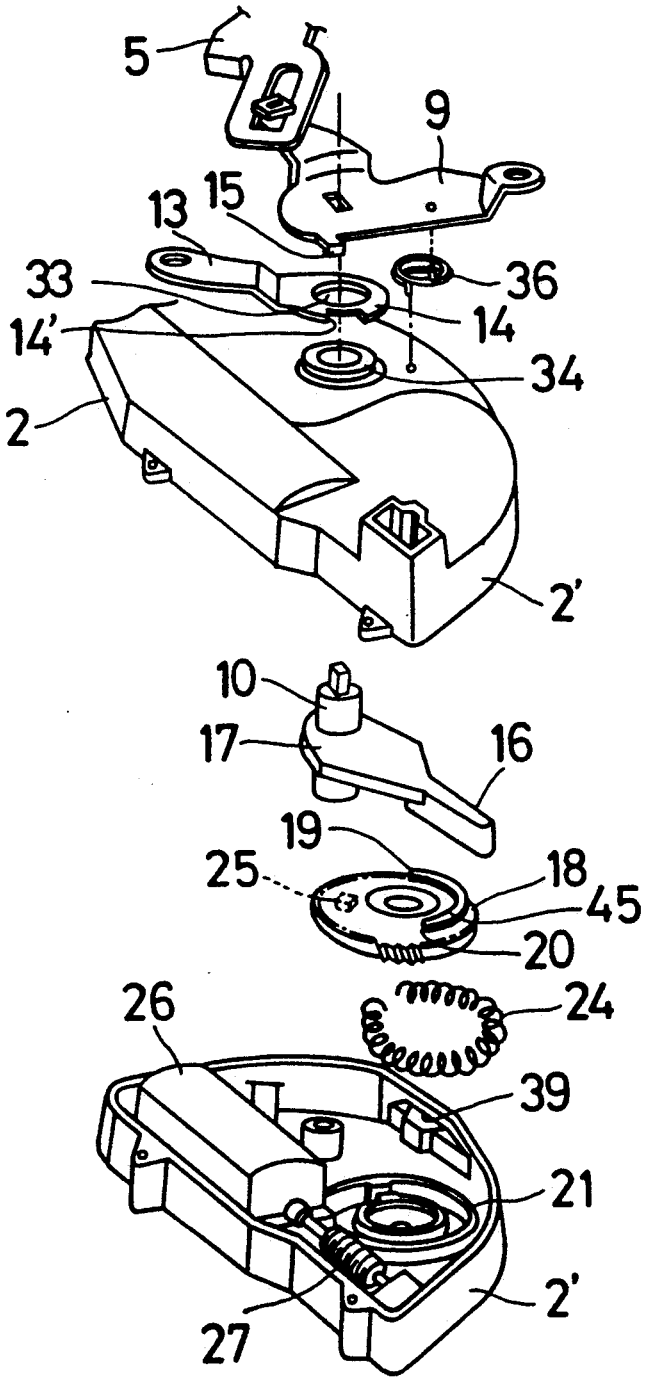
FIG. 9 is an exploded three dimensional view of an actuator part.

In addition to said manual manipulation, the pin 10 is turned electrically in response to the instruction signal from a driver and the locking arm 9 is either turned clockwise or counterclockwise so that the possible conditions of locking and unlocking can be effected. Referring to FIG. 9, a handling lever 17 having an arm means 16 is fixed to the pin 10. An arcuate protrusion means 45 having end portions 19, 20 extend from a wheel gear 18, which is rotatably mounted to the housing. End portions 19, 20 face opposite sides of the arm means 16, at a front end of the handling lever 17.

Figure 10:
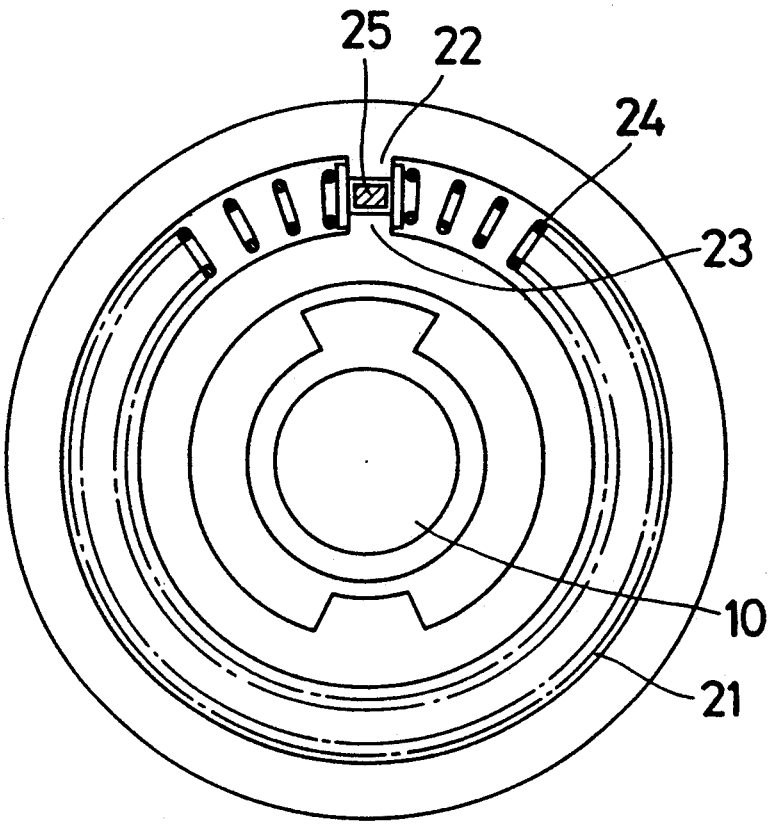
FIG. 10 is a plan view of a return spring assembly of FIG. 9.
Figure 11:
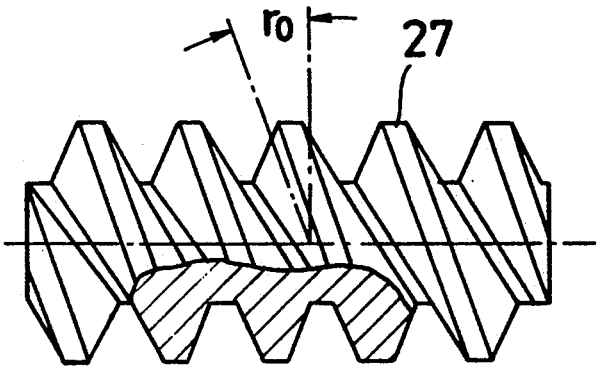
FIG. 11 is a side view of the worm of FIG. 9.

An annular groove 21 is provided in a bottom part of sub-housing 2'. This groove 21, as shown in FIG. 10, has a portion of decreased width defined by wall surfaces 22, 23 opposing each other radially. A coil spring 24 is inserted in the groove, and its opposite end portions abut the shoulder of the wall surfaces 22, 23. Further, a protruding piece 25 projecting from the bottom surface of the wheel gear 18 is disposed to fit in the space between wall surfaces 22, 23. As a result, for example, when the wheel gear 18 is turned clockwise as viewed in FIG. 10, the protruding piece 25 pushes the right end of the spring 24 and compresses the spring 24. The left end of the spring 24 abutting the shoulder of the wall surfaces 22, 23, makes compression of the spring 24 possible. The turning of wheel gear 18 causes the end portion 19 of the arcuate or convexed portion 45 to abut the arm means 16, the turning of the handling lever 17 and the pin 10, and also the moving of the locking arm 9 from A position to B position. The turning of the wheel gear 18 counterclockwise causes the protruding piece 25 to engage the right end of the spring 24 to the shoulder of the wall surfaces 22, 23, compressing the spring 24 counterclockwise, turning the handling lever 17 and the pin 10 by the end portion 20. This causes the locking arm 9 to be moved from B position to A position. The annular groove 21 supports the whole length of the spring 24 permitting to be long, so that sufficient flexibility is ensured.

The wheel gear 18, which is rotatably mounted to the housing, is meshed with a worm gear 27 directly coupled to an electric motor 26, and the rotational direction of the wheel gear 18 is controlled by the electrical control of the motor 26. In general, when advancing angle $\gamma o$ of the worm gear becomes larger than a friction angle $\phi$, transferring to rotational torque from the wheel gear 18 to the worm gear 27 becomes possible. In this example, the advancing angle exceeds the frictional angle ($\phi = 8.53°$) by applying the relation of $\mu$ (friction coefficient) $= \tan \phi$. This is to say, since the frictional coefficient $\mu$ between the worm gear 27, which is made of phosphor bronze, and the wheel gear 18 which is made of synthetic resin is $0.1 \sim 0.15$, and the frictional angle $\phi = 5.71 \sim 8.53$, the rotation from the wheel gear 18 to the worm gear 27 is made possible by setting the frictional angle above 8.53. The selection of the advancing angle $\gamma o$ of this worm gear 27 makes it possible to return the wheel gear 18 to its original location by the spring 224 immediately after the operation. For example, even if the wheel gear 18 is rotated by the door lock handling applied with the electric motor 16 by a driver. Subsequent manual operation is possible. In other word, the electric operation subsequent to the manual manipulation or the manual operation subsequent to the electric operation is possible. Further, since the handling lever 17 and the wheel gear 18 are completely separated from each other upon manual operation, the arm means 16 is only idling between end portions 19, 20 of arcuate portion 45'; and therefore, it can be operated easily without using the motor means, and the manipulation has a good feel.

Figure 12:
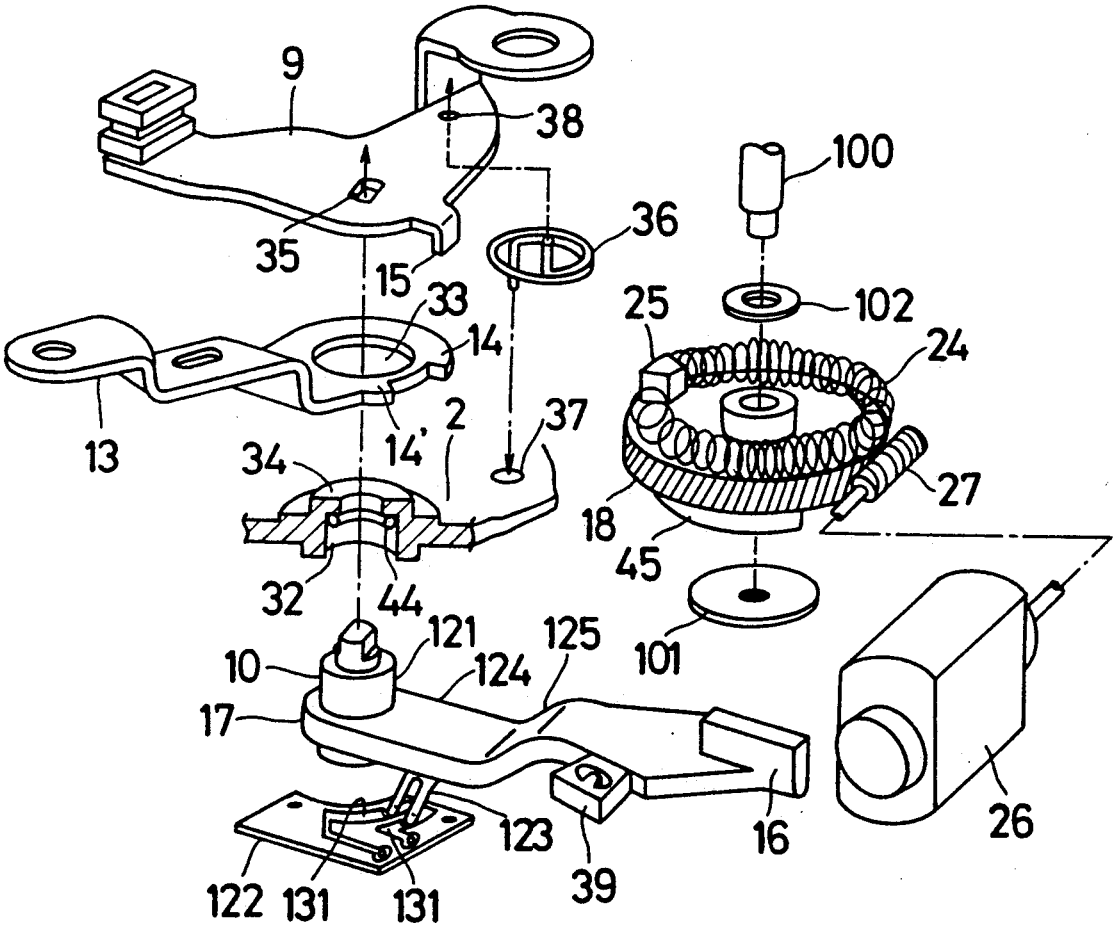
FIG. 12 is an exploded perspective view of the mounting part of the output shaft of FIG. 9.

As shown in FIG. 12, the pin 10 fixed to the handling lever 17 which is operated by the motor 26 within the sub-housing 2', has a stepped portion and a square shaped portion at its front end. Pin 10 fits in a stepped hole 32 of the sub-housing 2'. External peripheral surface of the stepped hole 32 serves as a bearing means 34 and fits in hole 33 of the key handling lever 13. The square shaped portion of the pin 10 protrudes from the bearing means 34 and fits in a similarly shaped hole 35 of the locking arm 9, and is fixed by riveting or the like. Further, the locking arm 9 is seated on the top surface of the bearing means 34. Since the bearing means 34 for the key handling lever 13 is formed integrally with the housing 2', a separate bearing is not required and the mounting portion of the locking arm 9 does not project beyond the external surface of the locking arm.

Figure 13:
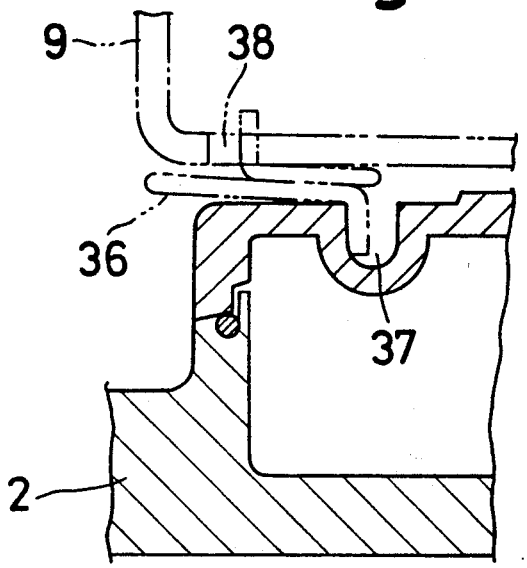
FIG. 13 is a side view showing the mounting of the turn over spring of FIG. 9.

Referring to FIGS. 12 and 13, each end portion of a turn over spring 36 urges the locking arm 9 to the locking and unlocking positions. End portions of spring 36 are mounted in a recess 37 of the housing 2 adjacent to the bearing 34; and in a hole 38 of the locking arm 9 substantially facing recess 37, respectively. In this example, since the pin 10 is coupled directly to the locking arm 9, the rotational power from the motor is efficiently transferred to the turn over spring so that the operating power is sufficient even if it is slight. This means that the motor 26 can be miniaturized, and the device as a whole can be made compactly.

As it is already understood from the description of FIG. 1, the axis 26 for becoming the rotational center of the release lever 3 is also the rotational center of the pawl of the door lock operation means which is not shown; and a pin 27 freely abutting the pawl moves the pawl to the latch releasing position; however, the door lock operation means fits in the housing 2. Various levers and arms as described above are arranged on the external surface of this housing 2. On the other hand, an actuator for rotating the pin 10, forming the output shaft including the motor etc. are received in the extended portion of the housing 2 of the door lock operation means. Further, the motor 26 and the wheel gear 18 are disposed in parallel planes, so that they transfer the driving power to the output shaft 10 through the speed reducing mechanism of a spur gear and the like, and the electric motor 26 turns the handling lever 17, and moves the locking arm 9 to the locking position (B) and the unlocking position (B') as shown in FIG. 1, but a resilient stopper 39 for limiting the handling lever 17 is disposed at these positions (B, B'). The operation of this stopper 39 will be explained with reference to FIG. 14 hereinafter. Although only one of the stoppers 39 is shown in FIG. 14, the drawing and description of the other is deleted because the operation of the other stopper is the same as stopper 39.

Figure 15:
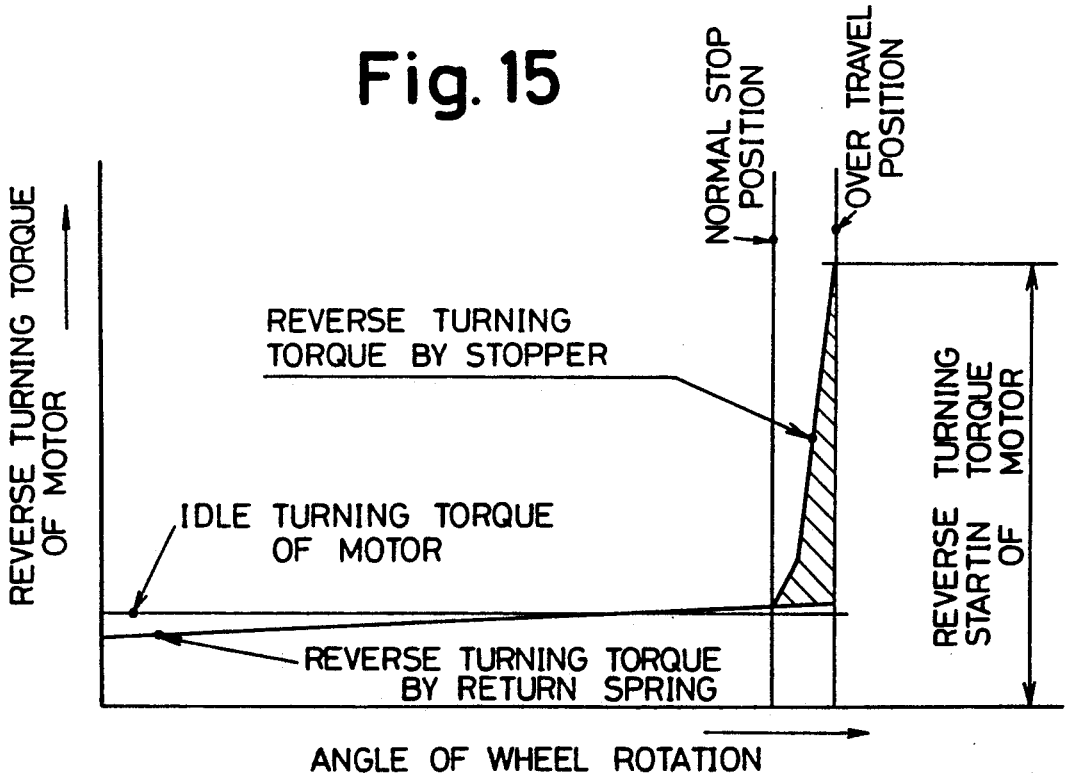
FIG. 15 is a graph showing a relation between wheel rotational angle and a motor reverse turning torque.
Figure 14:
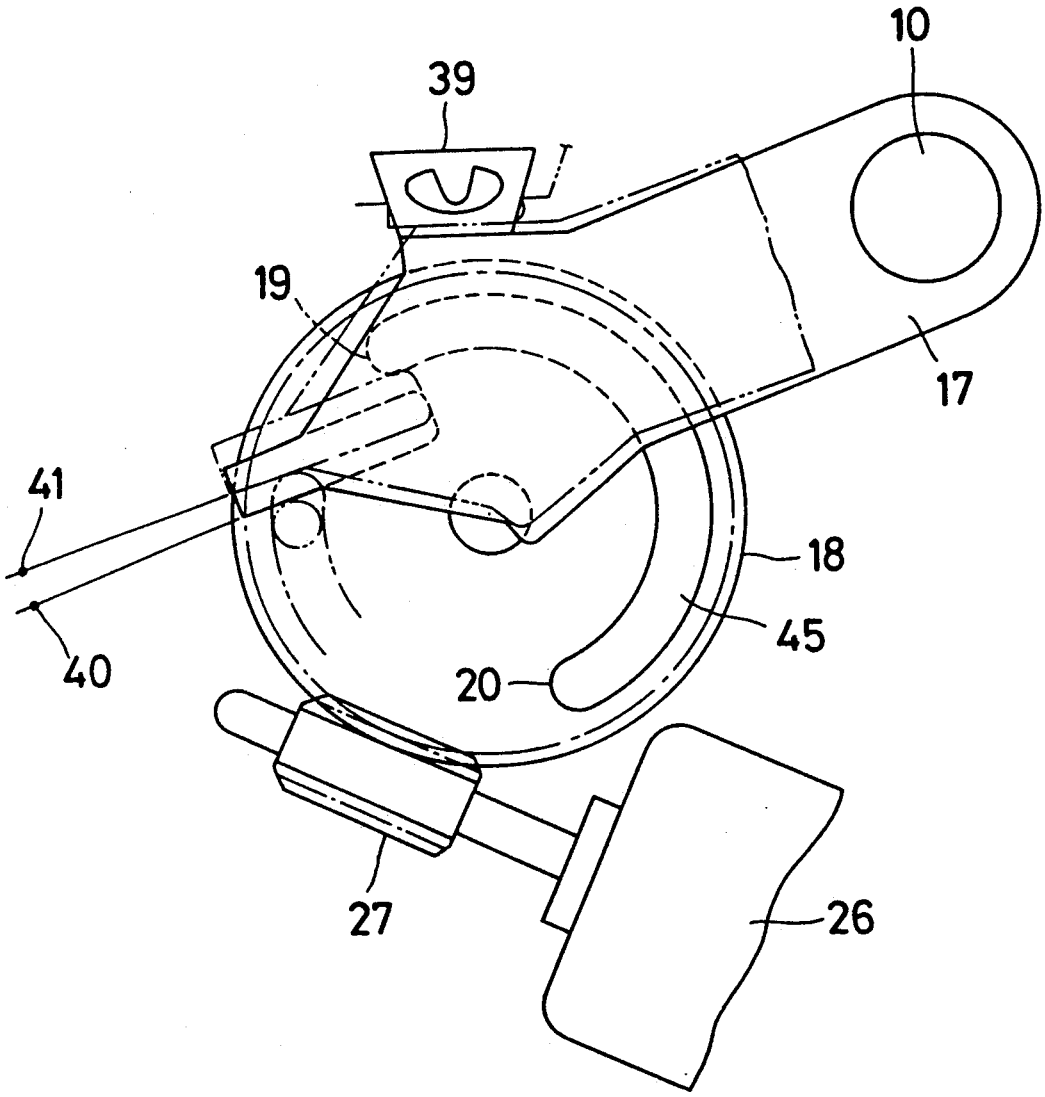
FIG. 14 is a plane view showing the relation between the and the operating lever of FIG. 9 and 12.

Referring to FIG. 14, electric motor 26 turns the wheel gear 18 through the worm 27, and turns the handling lever 17 together with the pin 10 by engaging the end portion 19 of the arcuate or convex portion 45. In this position, the return spring 24 is compressed, and the energy for returning the wheel gear 18 to the neutral position is stored. In this example, when the handling lever 17 comes to its regular limit position 40, the handling lever 17 and the stopper 39 are abutting, though stopper 39 interrupts the operation of the handling lever 17. However, the rotational power of the motor compresses the resilient stopper 39 which permits the handling lever 17 to move to the over travel position 41. That is to say, the stopper 39 is elastically transformed by the amount of the over travel. The elastic force of this stopper is formed from a solid or hollow body of rubber or synthetic resin and the like. In the event the electric motor is "off", the resilient elastic transformation pushes the handling lever 17 together with the spring 24 to the regular locking and unlocking positions, that is, the wheel gear 18 is returned to the neutral position. The auxiliary force of stopper 39 decreases the required urging force of the spring 24 as well as the output of the electric motor 26. The relation between the wheel gear 18 and the reverse rotational torque of the motor is shown in FIG. 15.

The relation between the pin 10 and the housing 2 as shown in FIG. 12, will be explained in more in detail with reference to FIG. 16. Pin 10 which is an output shaft fixed to the handling lever 17 is formed with a stepped structure including a large shaft diameter portion 40 and a small shaft diameter portion 41. Hole 32 of the housing 2 is formed with a large opening portion 42 for receiving the large shaft diameter portion 40 and a small opening portion 43 for receiving the small shaft diameter portion 41. Key lever 13 is rotatably mounted to the bearing means 34 of the sub-housing 2', locking arm 9 is fixed to the small shaft diameter portion 41 and both protrude from and are external to the sub-housing 2'.

In assembling pin 10 in the hole 32 of the sub-housing 2', "O"-ring 44 is fitted around shaft diameter portion 41 of the pin 10, and the output shaft 10 is inserted in the hole 32 from the interior of the sub-housing 2' such that the small shaft diameter portion 41 protrudes from the sub-housing 2'. The insertion of the output shaft 10 in the hole 32 causes stepped portion of the sub-housing 2' surrounding hole 32 to oppose the stepped portion of the pin 10 through the "O"-ring 44. Thus, the moving of the pin 10 with respect to the sub-housing 2' is defined. This is useful for obtaining the correct movement of the handling lever 17. Also, the mounting operation is very easy because it is sufficient if "O"-ring 44 is first attached to the pin 10; and then inserted in the hole 32 of the sub-housing 2'.

Figure 16:
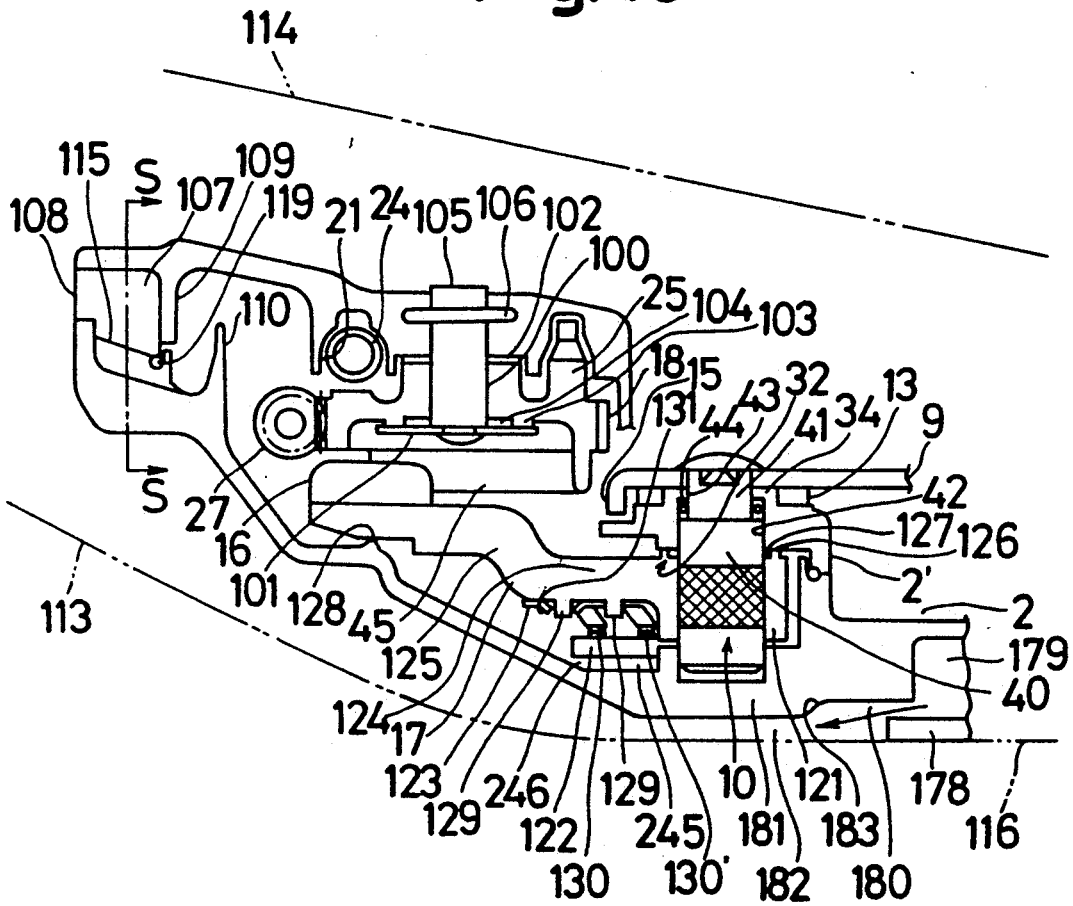
FIG. 16 is a fragmentary cross sectional view of an output shaft assembly.
Figure 17:
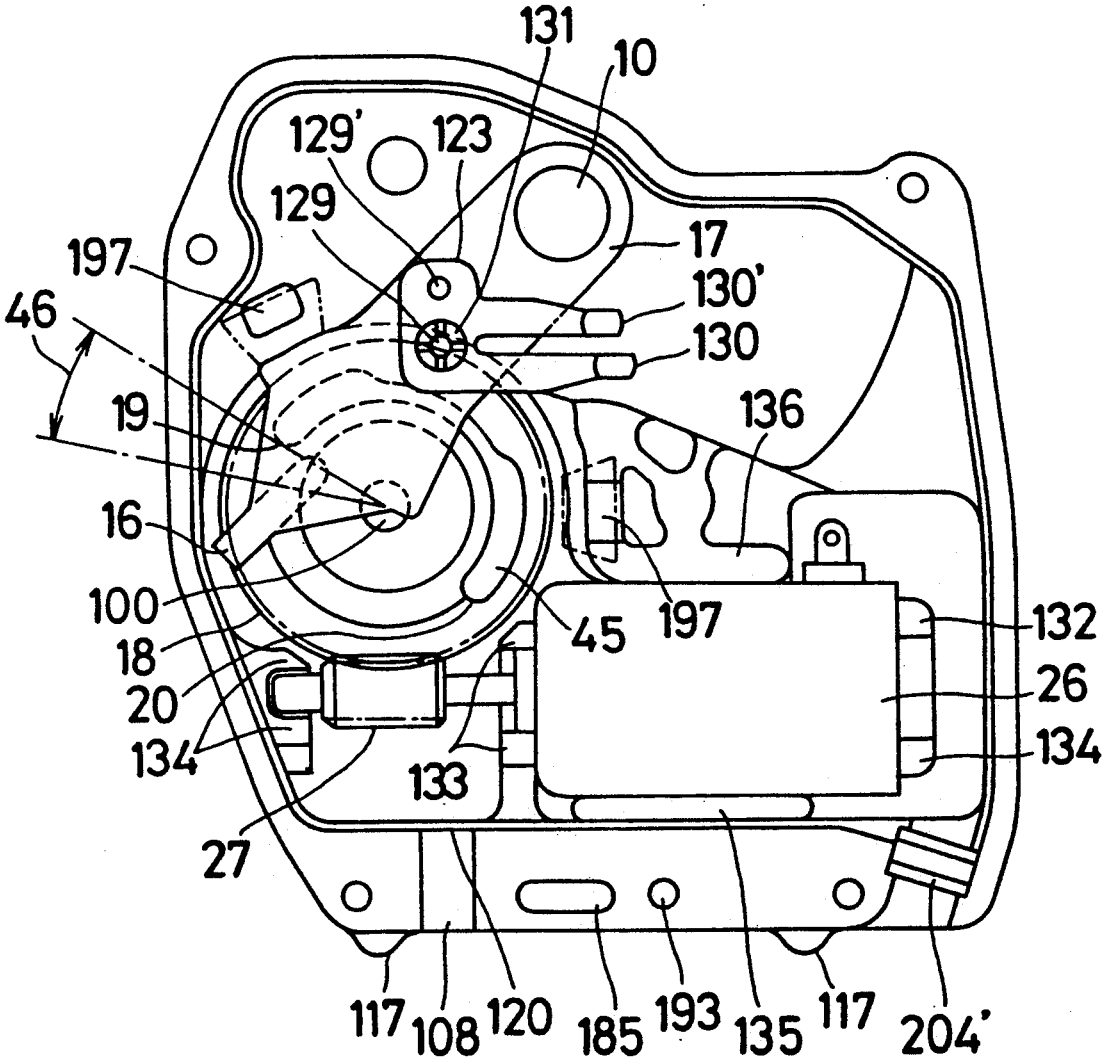
FIG. 17 is a plan view of the actuator means assembly of FIG. 9.

In the example shown in FIG. 16 and 17, a projecting portion 45 of arcuate shape is provided on the wheel 18, for rotating handling lever 17. However, a pair of the pins may be mounted on wheel 18 instead. End portions 19, 20 of arcuate portion 45 freely abuts arm 16 of the handling lever 17. When the electric motor 26 is electrically energized, the wheel 18 is rotated through the worm 27. One end of the arcuate portion 45 abuts arm 16 in response to the rotational direction of the wheel gear 18; and while compressing the return spring 24, the handling lever 17 is moved to the locking or unlocking positions, and the pin 10 becomes the output shaft which moves the link mechanism. When the handling lever 17 occupies the locking or unlocking position, and the electric motor 26 is shut OFF, the urging force for releasing the compressed return spring 24 rotates reversely the wheel 18, the worm 27 and the motor 26, in reverse, and wheel 18 to the neutral position. When the wheel 18 is returned to the neutral position, as shown in FIG. 17, a gap remains between the end portion of the arcuate portion 45 and the arm 16. This gap 46 permits the number of revolutions or RPM's, of the motor to immediately reach the standard rate when electric power is fed to the electric motor 26. Thus, when the arcuate portion 45 abuts the arm 16 of the handling lever 17, inertial energy of the output shaft of the motor exceeds the static friction of the inertia of speed reducing means, door lock mechanism and the like. That is to say, in case that the arcuate portion 45 abuts the arm 16 of the handling lever 17, the rotational inertia energy of the motor is transferred to the arm 16, so that miniaturizing of the motor is possible.

Figure 18:
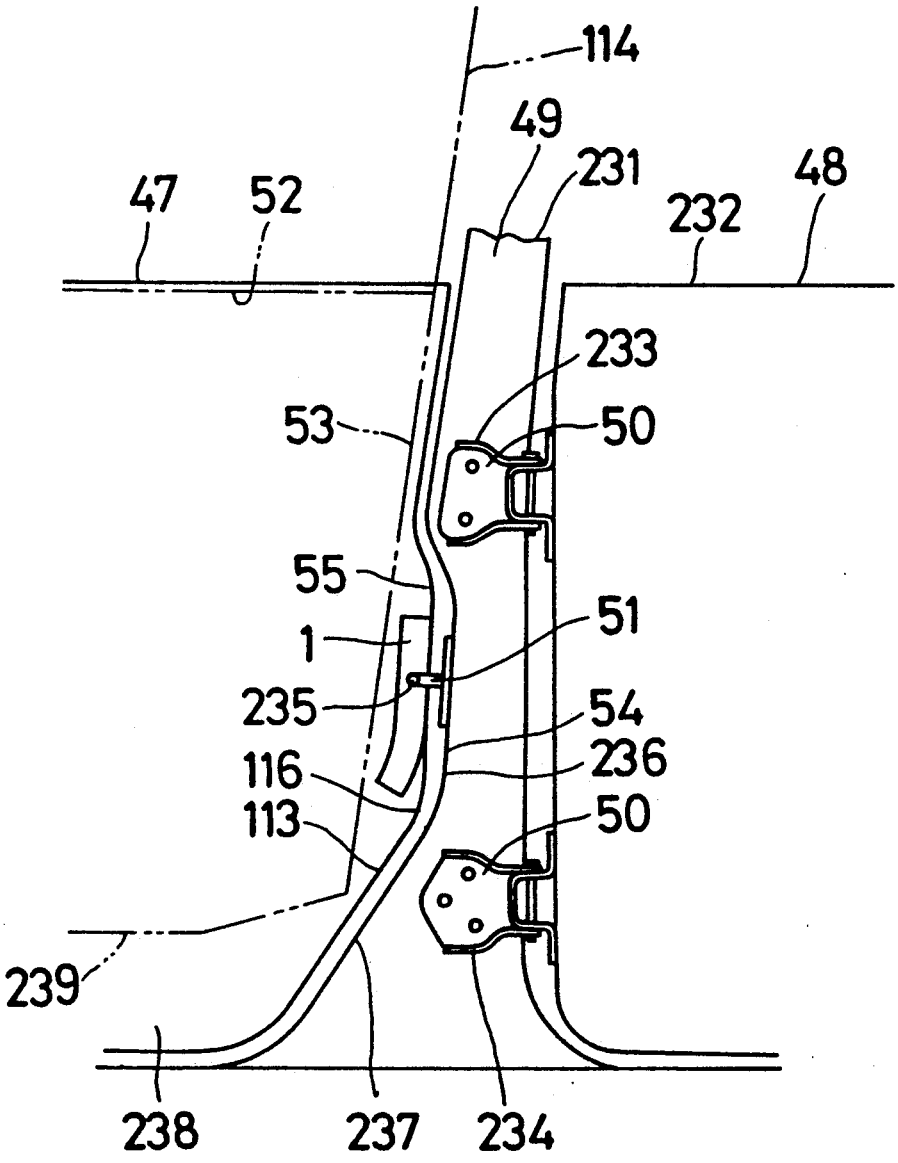
FIG. 18 is a schematic front view illustrating the embodiment of FIG. 1 mounted to the vehicle door.

Door lock device 1 has been described previously. Reference to FIG. 18 is now made with respect to the mounting portion of the door lock device. A vehicle typically has a center pillar 49 between front door 47 and rear door 48. Hinge 50 and striker 51 for the rear door 48 are fixed to this center pillar 49. Striker 51 can be coupled or released freely with a ratchet of the door lock deice 1 (not shown) upon opening or closing of the front door 47. On the other hand, window glass 52 of the front door 47 is moved along with track 53 alongside the center pillar 49 upon raising and lowering thereof. Accordingly, the door lock device 1 fixed to the front door 47 is required to avoid the track 53 of the window glass 52, and to prevent interference between the window glass 52 and the door lock device 1. For avoiding this interference, rearwardly recessed concave-shaped portion 54 is formed in front edge of the center pillar 49, and a projected mating portion 55 is formed in the rear edge portion of the front door 47.

The door lock device 1 is received within this projected portion 55. That is to say, the door lock device 1 is required to have an external configuration for being contained within the space defined by this projected portion 55. Further, the shape of projected portion 55 and concave shaped portion 54 are disposed so as not to interfere with lower hinge 50 of the rear door 48. In this example, rear edge configuration of the front door 47 is formed in a shape shown by 113.

As it is apparent from FIG. 16, the lower part of the main housing 2 is extended, and the actuator is supported by the sub-housing housing 2', an electric actuator is mounted in this extended portion; and sub-housing 2' is fixed to the main housing 2. The main housing 2 is configured to be contained within the projected portion 55 of said defined space, and extends forwardly at its lower part.

Figure 19:
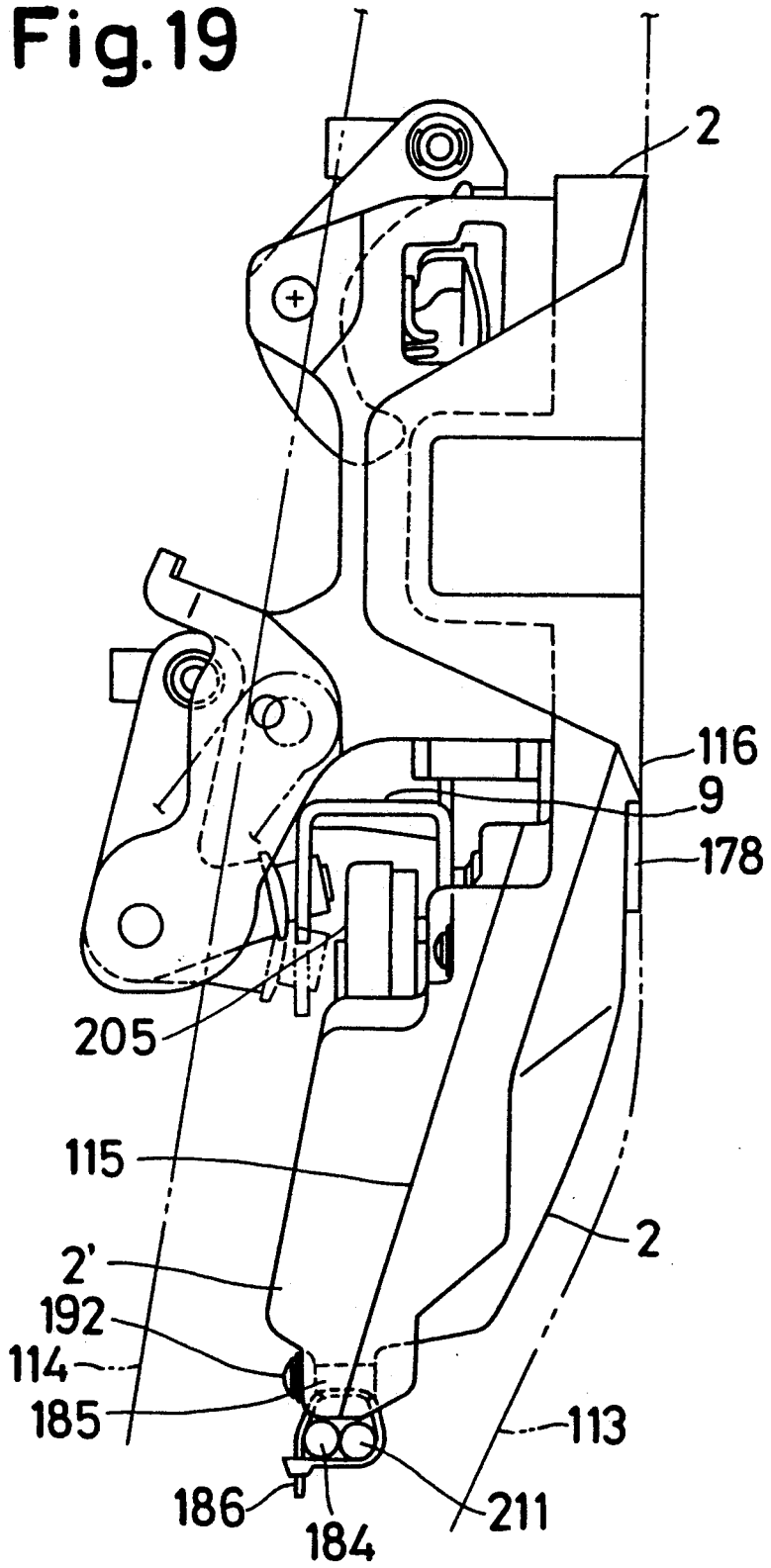
FIG. 19 is a front view of the door lock device of FIG. 1.

Referring FIG. 19, matching surface 115 of the sub-housing 2' to be fit or matched to the main housing 2 whose lower part bends or curves forwardly is formed to slant in a straight line with respect to a mounting surface of the door lock device 1. In order to increase the sealing effect of both housing 2 and 2', i.e., in order to prevent the miss-matching of the matching surface 115 of both housings 2 and 2', a pair of hooks 117 are provided at the lower part of the sub-housing 2' as shown in FIG. 1, and these pair of hooks 117 abuts the bottom end surface of the main housing 2. The abutment of the hooks 117 to the bottom end surface of the main housing 2 is shown in FIG. 20 and prevents the mis-matching upon coupling of housings 2 and 2' and provides a better seal also it prevents the deviation of the axis between the pin 10 of the output shaft and the pin receiving hole of the housing 2.

Figure 20:
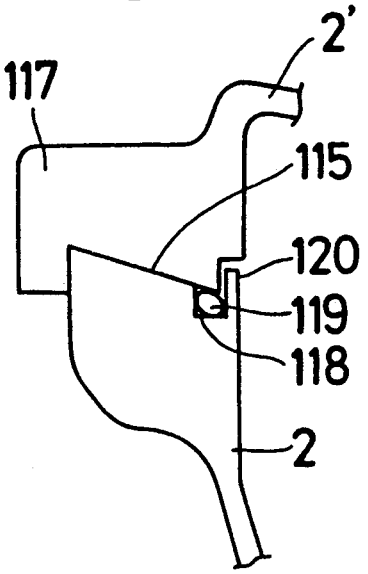
FIG. 20 is a partial cross sectional view showing the "O"-ring between the housing and sub housing.

Referring again FIG. 20 a substantially U-shaped groove 118 is provided along internal side edge of the main housing 2, and rubber "O"-ring 119 is inserted in this groove 118. Sealing pressure is ensured by compressing the "O"-ring 119 to the matching surface 115 of the sub-housing 2'. Internal side edge of the main housing 2 has an upwardly extended ridge or wall 120, and therefore, even if rain water or dust may get past the "O"-ring 119, entrance of the rain water or dust into the housing 2 is prevented by wall 120. Wall 120 is effective to increase the sealing effect where the matching surface of both housings 2 and 2' are fastened by adhering or welding, example.

Since the shape of the housing, as aforementioned, is formed with a substantially angular profile where the lower part extends forwardly of vehicle, the handling lever 17 extends downwardly in the vehicle or extends to left side of the drawing as viewed in FIG. 16 from shaft means 121 fixed at the output shaft 10. Lever 17 includes a step means or offset for adjoining or succeeding an arm means or section 124 which has contact points 123 for detecting the locking and unlocking state in cooperation with a base plate 122 fixed to the housing 2' and has another arm means or section 16 disposed so as to avoid interference with the lower extended shape of the housing.

Ring shaped arcuate portion 126 is formed on a surface shaft means 121 that abuts the bearing surface of the sub-housing 2', so the fitting in a thrust direction is made easy, and the contacting surface with the sub-housing 2' is minimized. Also rotational resistance is decreased, as well as defining a grease retainer 127.

Further, the arm means or section 16 is slidably supported by the convex portion 128 provided in the housing 2, to prevent increase of the rotational resistance caused by whole surface contact between the arm means and the housing.

Contact point 123 is formed with contacting means 130 and 130' sliding on base board 122 and fastening means fixed to protrusions 129' provided on the arm means 124 of the handling lever 17. A coupling means 131 is provided for preventing the protrusion 129 of the arm from withdrawing from the fastening means.

Figure 21:
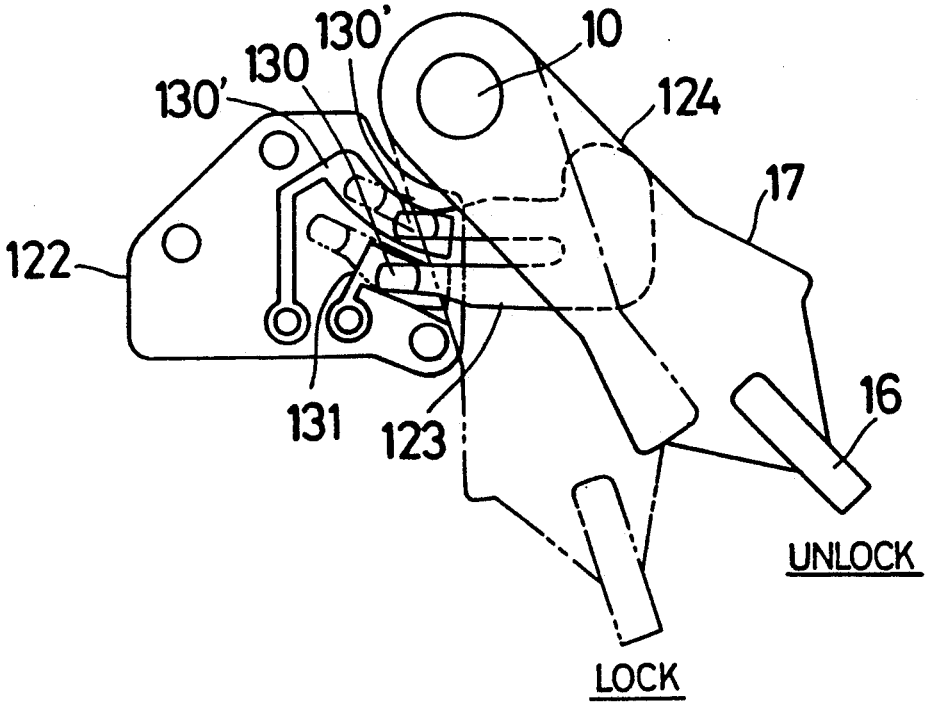
FIG. 21 is a plan view of part of a switch assembly of FIG. 17.

Operational condition of switch means is shown in FIG. 21. Base board 122 is made of insulating material such as epoxy resin or the like, and copper made conductive means 131 and 131' are arranged in the path of said contacting means 130 and 130'

In this embodiment the conductive means 131 and 131' is contacted by the contacting means 130 and 130'; and the detecting circuit when open is set in the unlocked state, and when closed it is set in the locked state.

Thus, since the switch means is provided at the handling lever 17 which is directly coupled to the locking lever 9 for switching between locking and unlocking, improvement in the accuracy of detecting the position can be realized. Since the arrangement to avoids an overlapping of the base board 122 fixed to the housing 2 with the protrusion 129 for fixing the contact point of the arm means 124 of the handling lever 17, the base board and the arm means can be located as close as possible, and the height of the driving means is lowered.

Figure 22A:
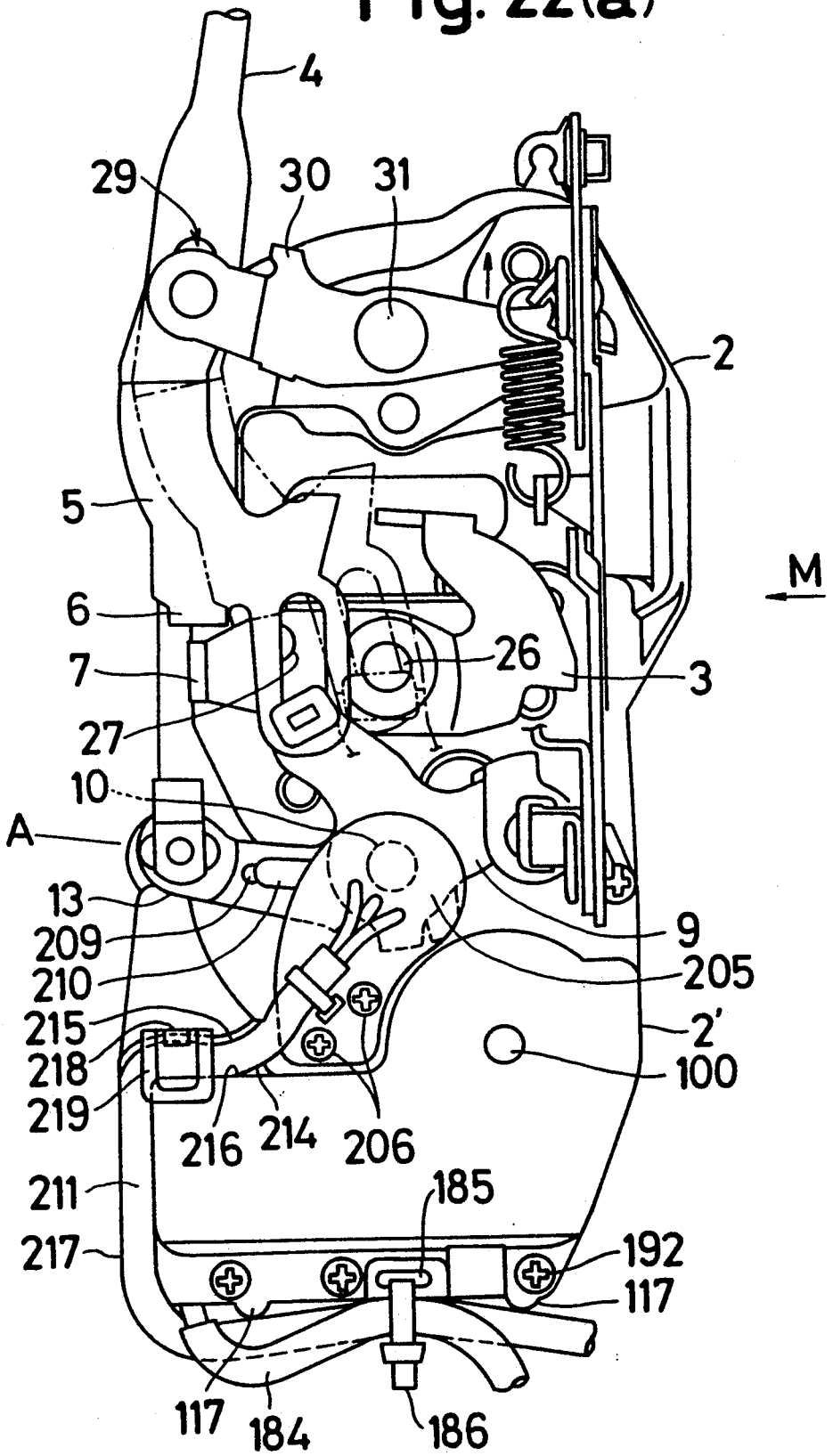
FIG. 22(*a*) is a more detailed front view of the door lock device of FIG. 1.
Figure 22:
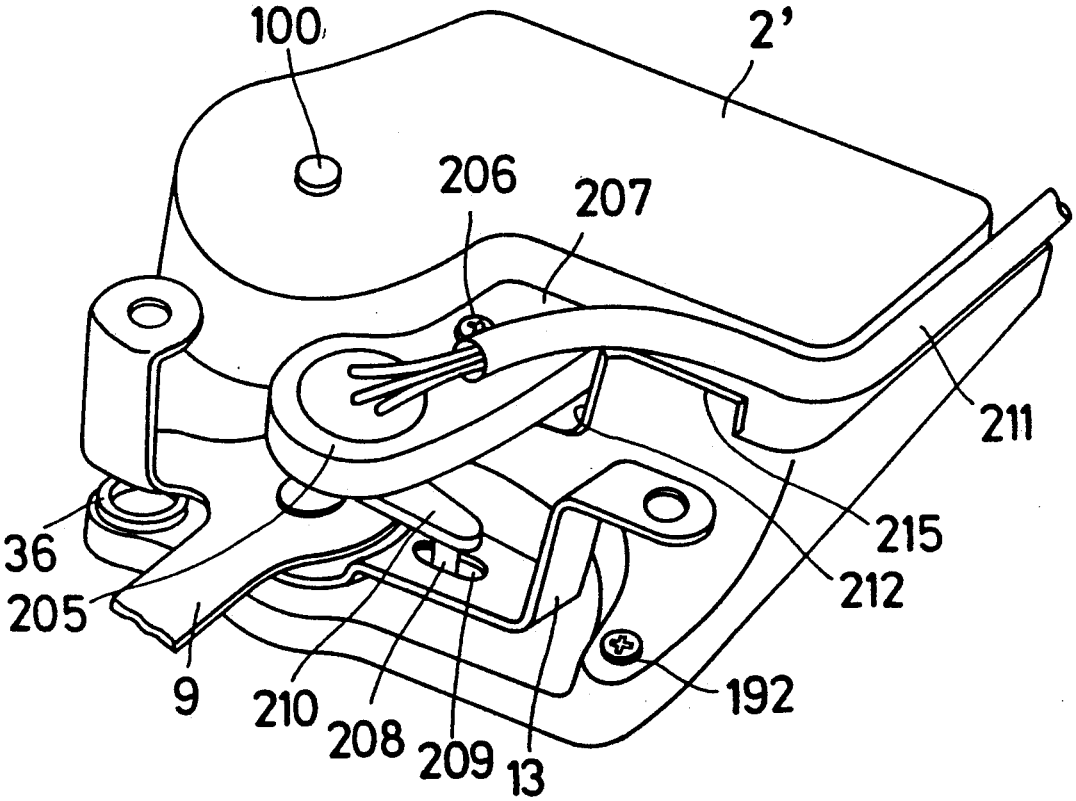
Figure 23:
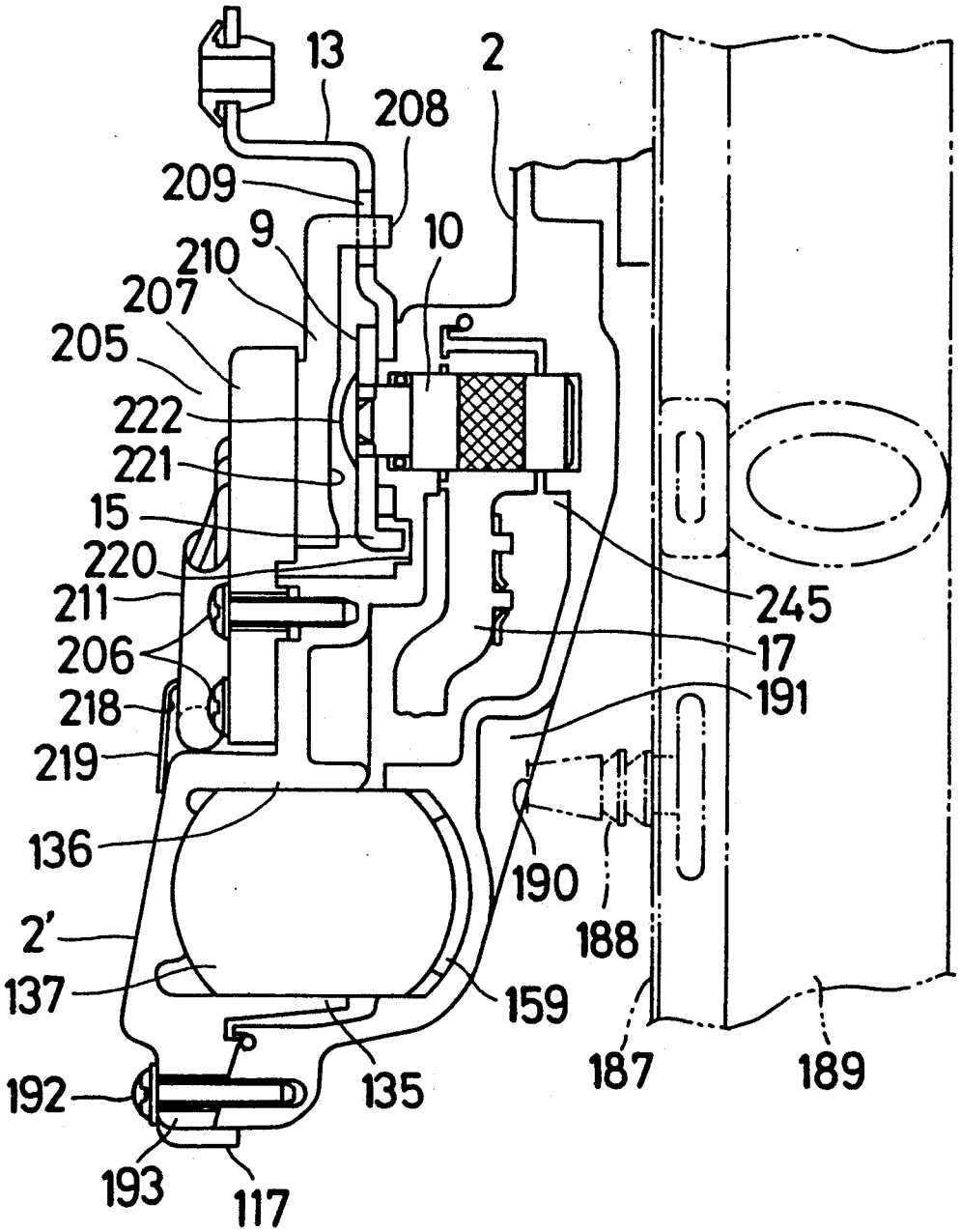
FIG. 23 is a side cross sectional view of the actuator assembly mounted on the sub housing.

Referring to FIGS. 22 and 23, a sealing means 189 made of rubber or the like for sealing between the door and the body is fixed to a door panel 189 with a clip 188 disposed so as to extend above the actuator means of the door lock, and interference with an end 190 of said clip 188 becomes a problem.

In this embodiment, in view of the empty space in the upper part of the receiving means of the motor of the housing 2, a concave portion 191 is formed as deep as possible to provide a gap between the end 190 of the clip 188 and housing 2.

Thus, a concave portion for avoiding interference between the front end of the clip on the housing is further provided at angularly shaped actuator means (<-type) so that the required space between door panel 113 of FIG. 19 and the lifting and lowering track 114 of the door glass can be decreased; and a compact door lock which may be arranged in a vehicle with a high degree of freedom is obtained.

Figure 24:
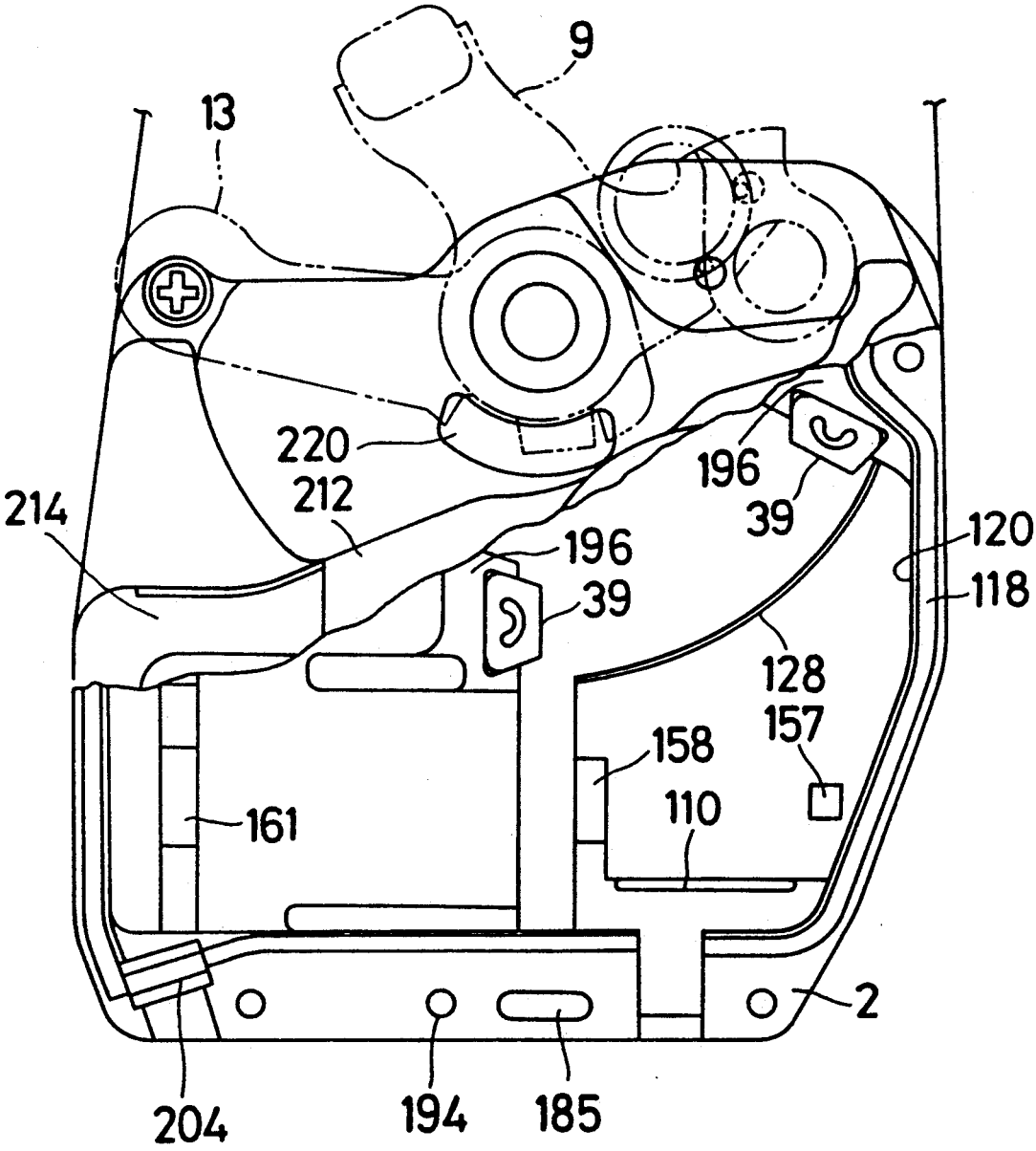
FIG. 24 is a plan view of the actuator assembly.
Figure 25:
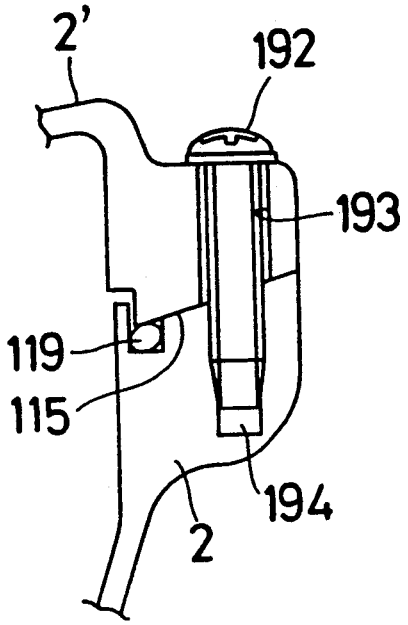
FIG. 25 is a fragmentary sectional view of the screw coupling joint between housing and sub housing at the lower end as shown in FIG. 23.

In the embodiment of FIG. 22, coupling between the housings 2 and 2' is carried out by screw 192. As shown in FIGS. 17 24 and 25, the housing 2' includes a hole 193 larger than the external diameter of the screw 192 passing therethrough, and housing 2 includes a coupling hole 194 slightly less than the external diameter of the screw 192.

Figure 26:
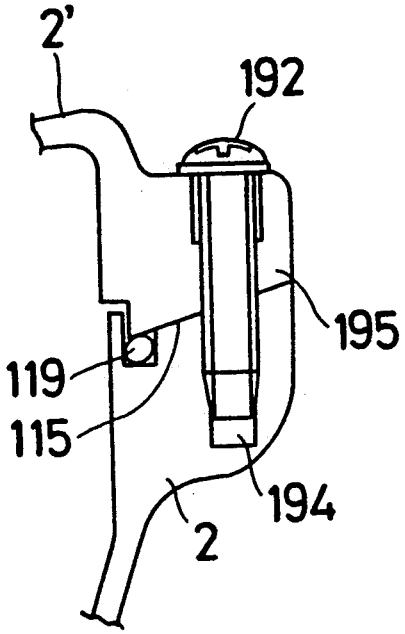
FIG. 26 is a cross sectional view of another screw coupling joint between housing and sub housing except in a different position.

Referring FIG. 26, in order to prevent the relation of the housings 2 and 2' being mis-matched in coupling, the holes of the housing 2' defined on the diagonal line are made with holes 195 slightly less than the external diameter of the screw 192, and a structure for coinciding automatically the center of the screw shaft and the center of the hole upon coupling the screw 192 is provided.

Thus, the output power loss at bearing means of the pin 10 arising from mis-matching between the housings 2 and 2' is decreased by the centering structure which is cheap and does not take up much space. Also output of the motor can be lowered; and miniaturizing of the motor and smooth and silent operation is obtained.

Figure 27:
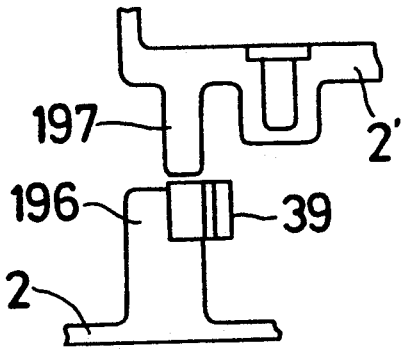
FIG. 27 is a cross sectional view showing a receiving state of a stopper.

Referring FIGS. 17, 24 and 27, a draw preventing means 197 is provided at a position opposite to the stopper 39 of the sub-housing 2' so housing 2 will not slip relative to stopper 39 which is supported by a stopper supporting means 196 of the housing 2.

Thus, a shock load including rotational inertia load of the motor is applied to the stopper 39 through the handling lever in the locking and unlocking position, and elastic transformation occurs by providing the draw preventing means 197. The stopper is interrupted by the draw preventing means 197 from being pulled out of said stopper retaining means 196, so that the retaining of the stopper 39 is assured after repetitive loading and stable performance can be maintained for a long period of time.

Further, since the stopper means is contained between the housings 2 and 2', performance deterioration of the stopper rubber because of the adhering foreign substance, such as rainwater, dust and the like is not present, and therefore durability is excellent.

Figure 28:
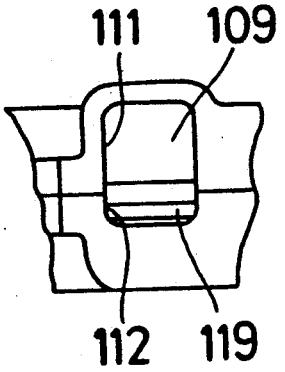
FIG. 28 is a sectional view taken at arrow S—S of FIG. 16.

Air discharging from the interior of the housing will be explained with reference to FIGS. 16 and 28 hereinafter. Air hole 107 formed in cooperation with the housing 2' is provided at lower end (left side as viewed in FIG. 16) of the housing 2, so that rainwater and the like adhering to the periphery of the housing is not sucked into the interior due to the interior of the housing negative pressure because of a change of environment, such as temperature.

Air hole 107 is formed substantially U-shaped by providing a wall 109 facing opening 108 and a wall 110 facing wall 109, the size of the hole is defined with substantially rectangular by walls 111 and 112. Therefore, even if a drip of water such as rainwater and the like, or dust adheres adjacent to the opening 108, leaking to the interior of the housing 2 is prevented by two walls 109 and 110.

Water discharging from the housing will be explained with reference to FIGS. 16 and 29. The locking mechanism for maintaining a closed door condition of known door lock is contained in space 179, which is formed between housing 2 and plate 178 of the door lock, which abuts a door lock mounting surface 116 of a door panel. A groove 180 formed adjacent plate 178 is provided at a lower portion of the space 179 for discharging of rain water and the like; and it extends as far as possible downwardly below the plate 178. A water path 182 is formed from a lower part of groove 180 between bearing means 181 of the pin 10, which is pulled to the door panel as close as possible. Groove 180 substantially terminates at a wall 183. Thus, by providing a wall 183 defining the groove 180, the dimension of the door lock actuator can be made thin in the longitudinal direction of the vehicle. A gap between the lifting and lowering track 114 of the door glass is ensured. The door lock device can be mounted in an upper position of the door, strength of upper part of the door against shock and the like can be increased, and increasing of area of the door glass can be realized or freedom of design can be increased.

Referring again to FIG. 16 the structure around the shaft 100 will now be described. The wheel gear 18 is rotatably fixed in the shaft 100 inserted to the sub-housing 2', and movement in an axial or drawing direction is limited defined by a washer 101 riveted to the front end of the shaft 100.

A washer 102 is inserted between the wheel gear 18 and the sub-housing 2' so as to decrease the resistance of rotation, and the contact between synthetic resin parts each is prevented. A ring shaped convex or projecting portion 103 is formed on a surface of the wheel gear 18 abutting the washer 101. Thus, tolerance in the thrust direction is made easy. At the same time, the abutting area of the washer 101 is decreased, rotational resistance is decreased, and also a grease retainer 104 is formed.

In order to increase the strength of the shaft 100 against bending or turning where it is inserted in the housing 2' by arising out of locking of the worm gear 27 with wheel gear 18; and to increase the supporting strength in the of thrust direction, and for receiving upon riveting of the washer 101 to the front end of the shaft 100. End 105 of shift 100 projects to the exterior from the surface of the sub-housing 2', and a path for rain water and the like leaking through the gap is elongated; and flange portion 106 is provided so as to prevent the intrusion of a rain water.

FIG. 17 is a diagram shown from the interior of the sub-housing 2', which illustrates the relative location of the pin 10, handling lever 17, wheel gear 18, motor 26, and worm gear 27. As is apparent from FIG. 16, the pin 10 is supported by bearing means 34. The wheel gear 18 is supported by the inserted shaft 100, and the worm gear 27 and the motor 26 is supported by the supporting means 132, 133, 134 provided in sub-housing 2', and also rotational movement of the motor itself is prevented by walls 135, 136.

Thus, since the positional relation of driving power transferring system, particularly meshing relation of the wheel gear 18 and the worm gear 27 are determined only by the sub-housing 2', manufacturing errors, such as distance between pitches of the gear and the like can be minimized, smooth power transfer can be obtained, and miniaturizing can be realized because loss of output of the motor is decreased.

Figure 30:
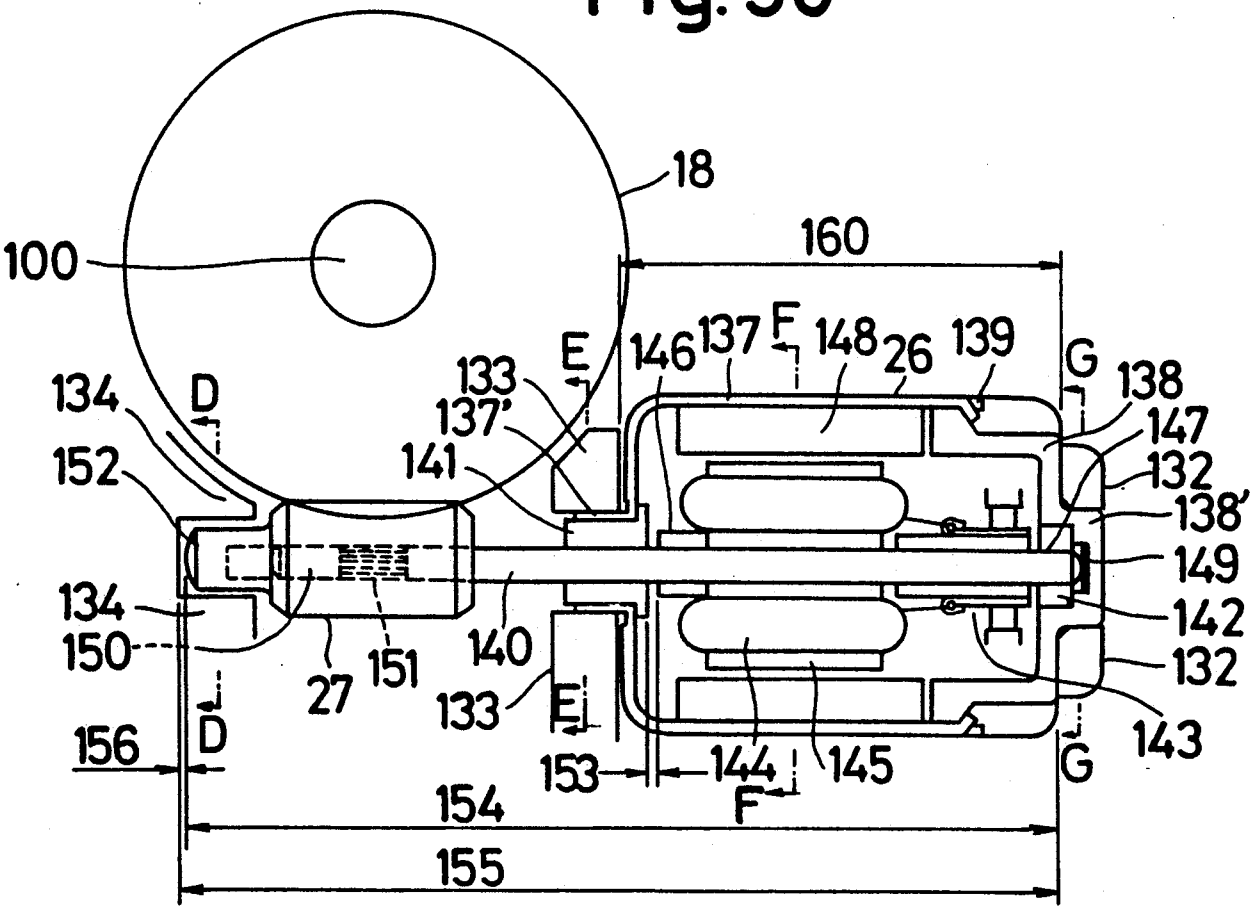
FIG. 30 is a plan view showing the supporting mechanism of a motor and a worm gear shaft.

The supporting structure of the motor will now be described with reference to FIG. 30. A casing 137 made of steel plate formed by deep drawing is attached to a casing 138 made of synthetic resin or the like, by nail means 139. The motor shaft 140 is rotatably supported by a bearing 141 fixed to the bearing assembly 137' of casing 137 by press fitting or the like, and by a bearing assembly 138' of the case 138 by press fitting or the like. A commutator means 143 for receiving the externally supplied electricity and a core supporting the coil windings 144 are fixed to the motor shaft 140.

Collars 146 are disposed between the core 145, coil winding 144 and case or casing 137 so as to prevent the interference therebetween. Magnet 148 is fixed at casing 137.

An end 147 of the motor is formed into a spherical shape; and it is supported by metal made thrust plate 149 provided in synthetic resin casing 138.

Thrust plate 149 is effectively used for preventing cracking of synthetic resin casing 138 by resisting the load when the worm gear 27 is jammed to the knurled portion 151 by pressure from another end of the motor, and for improving durability by receiving the thrust load occurring upon locking and unlocking. The relative position of the motor and position of shaft 100 supporting the wheel gear 18 in a direction of thrust is determined by the supporting means 133 for supporting the bearing means 137' of the case 137 and the supporting means 132 for supporting the bearing means 138' of the case 138.

The supporting means 134 for supporting the shaft position 152 of the front end of worm gear 27 is formed into a spherical shape.

The motor shaft 140 is movable in the thrust direction for as much as a gap 153 defined between the collar 146 and the bearing 141.

Further, when a load is applied to motor 140 in the direction of pushing axially into the motor casing; and an end 147 of the motor shaft contacts the thrust plate and rotate, the motor shaft is rotated with light torque because the contact with surface and also the rotational resistance are small. On the contrary, when a load is applied in a direction of axially pulling in a direction out of the motor shaft, an end surface of collar 146, and an end surface of bearing 141 make contact, the rotational resistance is large; and therefore a large torque is required for rotating the motor shaft.

As in the preferred embodiment, in a worm coupling, the load is produced either in a direction of pushing in the motor shaft or in a direction of pulling out the shaft in accordance with the regular or reverse direction of rotation of the motor, so that output of the motor becomes requires a larger output, considering the amount of rotational resistance. Further, when electric power is cut after the motor is driven, in a mechanism which drives the wheel gear 18 by the return spring 24 and returns to neutral position by rotating the worm gear 27, the output of the return spring also should be increased as much as the larger rotational resistance of said motor shaft, so that increasing the output of motor is required by as much as said amount of resistance. Thus, in order to prevent the contact between the collar 146 and the bearing 141 which produces various output power loss, a gap 156, gap 159 is provided between the means 152 of front end spherical shape of worm gear 27 and the supporting means 134 absorbs the manufacturing error of motor shaft length 154 and the length up to the thrust load receiving surface of the supporting means 134, which is less than the gap 153 between the collar 146 and the end surface of the bearing 141.

Therefore, even when the motor shaft 140 is moved in an axial direction or pulled out from the case, it abuts the front end of the spherical shape of shaft means 152 of worm gear 27 and supporting means 134. Contact between each end surface of the collar 146 and bearing 141 can be avoided, increasing the rotational resistance is prevented, and the output power loss of the motor is prevented, so that miniaturizing of the motor can be achieved.

Manufacturing error of the supporting means 132 and 133 is limited in a direction corresponding to a gap between motor case by an amount that can not be absorbed by the resilient transformation of support means 133. When the motor is mounted, it abuts the case 138 via supporting means 132.

A very small gap is established between the supporting means in the direction of shaft means 152 of worm gear 27. For example, it is made to abut when the handling lever 17 stopped at the locking and unlocking position, and when the distance between pitches is going to be increased by the reaction force of the coupling with the wheel gear 18.

When electric power for the motor is cut wheel gear 18 is driven by the return spring, and the worm gear 27 is rotated to return it to the neutral position. Since the abutment of supporting means 134 with shaft position 152 is released, the loss of force of the return spring does not arise at this point. Accordingly the force of the return spring can be made less, and therefore miniaturizing of motor also can be realized. Further, since the supporting means 132 and 133 usually determines the position of the motor shaft, manufacturing errors become are easily accommodated, and also low cost housing can be used.

Figure 31:
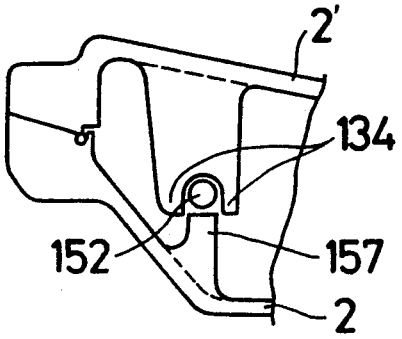
FIG. 31 is a sectional view taken at arrow D—D of FIG. 30.
Figure 32:
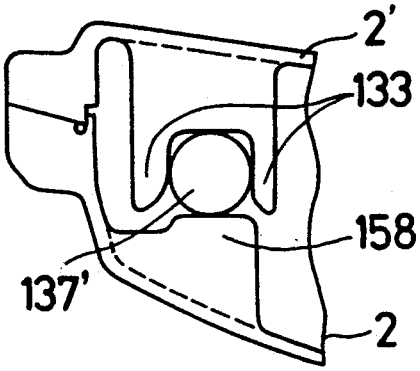
FIG. 32 is a sectional view taken at arrow E—E of FIG. 20.

The following supporting means or configuration are provided in the housing 2. As shown in FIG. 31, a supporting means or projection 157 abuts front end 152 of worm gear when displaced. As shown in FIG. 32, a supporting means ridge 158 is provided for supporting the bearing means 137' of the motor casing 137.

Figure 33:
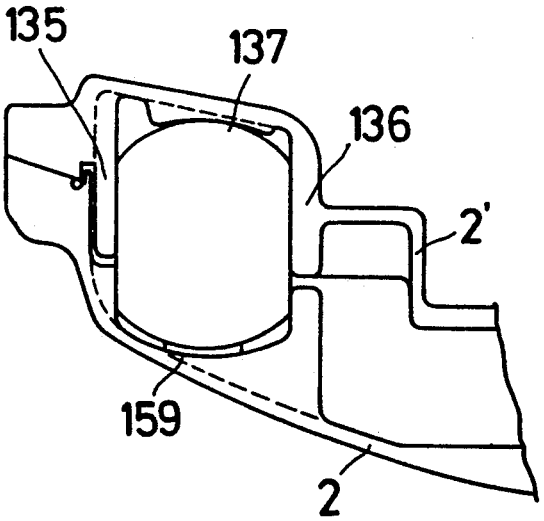
FIG. 33 is a cross sectional view taken at arrow F—F of FIG. 20.
Figure 34:
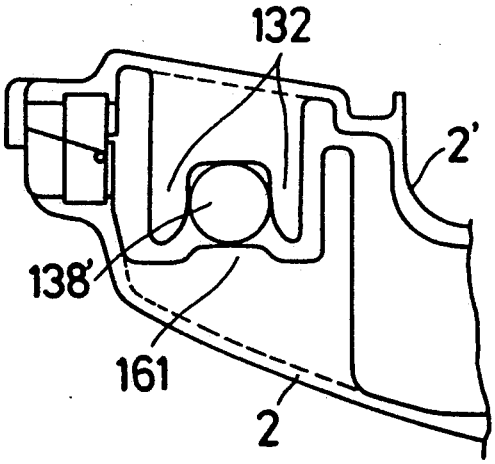
FIG. 34 is a cross sectional view taken at arrow G—G of FIG. 20.

As shown in FIG. 33, an elastic material 159, such as sponge and the like is flexibly provided between the housing 2 and motor case 137' which is supported by the sub-housing 2'. When the distance between the housing 2 and 2' is wider, or when the distance between the supporting means 132 and 133 is made larger causing a gap with the motor casing, the movement of the motor case by an opening and closing of the car door, vibration during running or a reaction force of the worm coupling during motor operation and the like, and occurring of undesirable sounds are prevented. As shown in FIG. 34, a supporting means or ledge 161 for supporting the bearing means 138' of motor casing 138 is provided.

Figure 35:
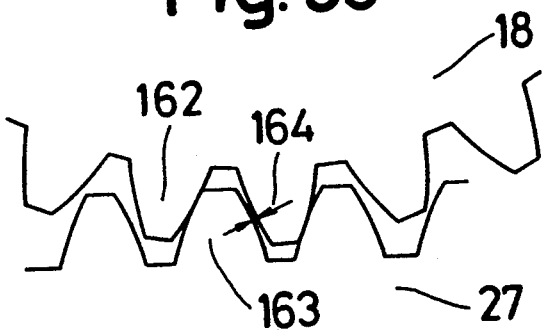
FIG. 35 is a fragmentary plan view showing the meshing of worm gear and wheel gear.

Next, is a description of the coupling of the worm gear 27 fixed to the motor shaft 140, and the wheel gear 18 coupled to gear 27. FIG. 35 shows a standard coupling state of worm gear 27 and wheel gear 18. Numeral 162 represents the teeth of wheel gear 18; 163 is the teeth of worm gear 27, and distance 164 is the backlash for the standard gears. As shown in FIGS. 16 and 17, the shape of the wheel gear 18 is complicated. Therefore it is manufactured from synthetic resin. Distortion of the external shape by molding may not be avoided, in an article of such complicated shape and unstable thickness; thus, in cases where the width of the teeth are increased, the backlash is decreased, and a smooth teeth coupling operation can not be executed; and when a sink occurs, a load is applied to the tip of the teeth, resulting in deterioration of its strength.

Figure 36:
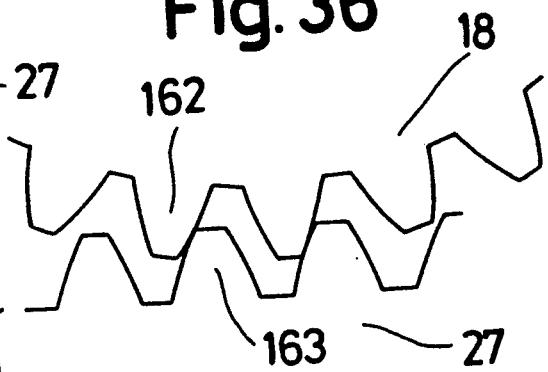
FIG. 36 is a fragmentary plan view magnified with an enlayed pitch between both gears (see FIG. 35)

In general, a method for taking a larger distance between pitches than the standard value of FIG. 36 is used for increasing the backlash. In a reducing gear means applied with a small gear, for example, in an article of pitch module 0.6 (tooth height 1.35 mm), increasing of distance between the pitches can not be obtained even by a very small amount, and thus the desired amount of backlash can not be obtained. The load is charged more to the tip of the tooth, in a matter of driving the lever and the like, which is limited in operation by abutting a fixed article; and since the motor rotation is suddenly stopped, particularly when stopping after a predetermined operation, a shock load including the rotational inertia energy of motor is present, so that the teeth themselves are damaged.

Figure 37:
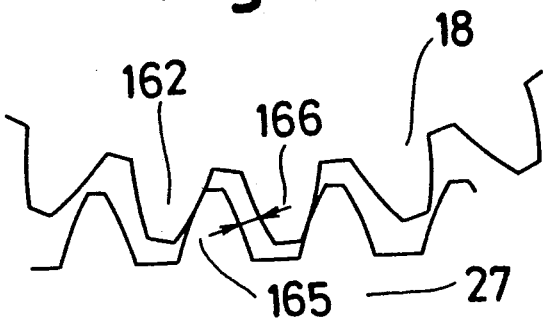
FIG. 37 is a fragmentary plan view showing a lateral transfer of a worm gear.

In the embodiment shown in FIG. 37, the tooth form and the distance between pitches of the wheel gear of synthetic resin are standard; and the backlash is increased by laterally transposing the teeth of worm gear 27 made of phosphor bronze which have a relative allowance in strength. Numeral 165 represents the teeth of worm gear 27 wherein that the tooth of each width has become smaller by lateral transposition, and 166 represents the backlash which is increased by lateral transposition. Thus, since the distance between pitches is standard, contact at the tip of the teeth is avoided, the loss of strength is less, and distortion of teeth of wheel gear can be tolerated.

Figure 38:
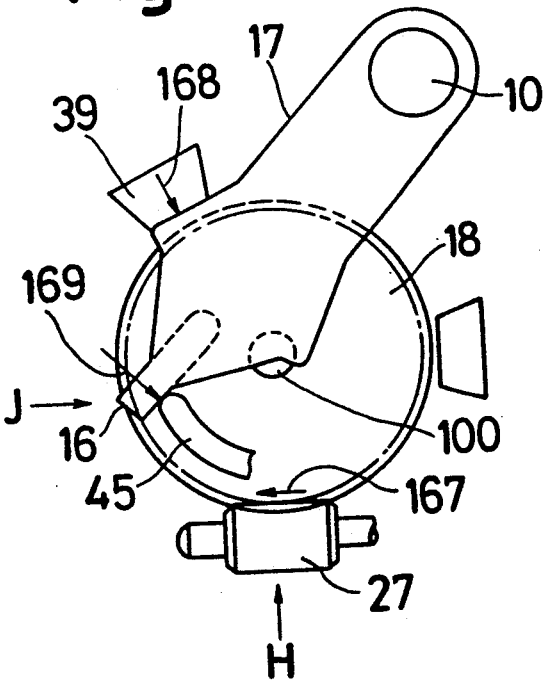
FIGS. 38 and 39 are plan views showing positions of the abutment and handling lever in the locked and unlocked positions.
Figure 39:
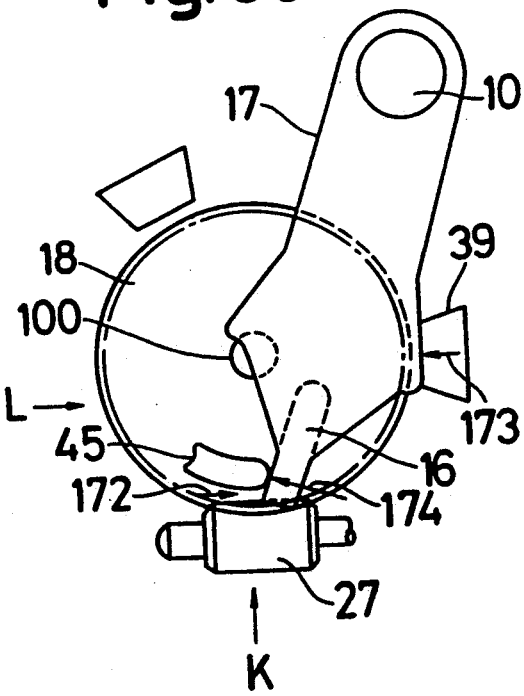

Next, will be described the relation between the tooth strip direction and the handling lever. FIG. 38 shows a state where arcuate convex portion 45 of wheel gear 18 which is meshed with worm gear 27, and the arm 16 of handling lever 17 are in contact with each other; and the lever 17 is moved to the unlocking position to contact stopper 39. FIG. 39 is a similar figure showing the state when it is moved to the locking position.

Figure 40:
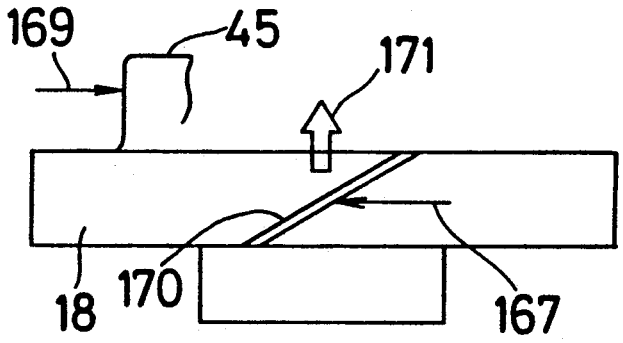
FIG. 40 is a diagram showing a component force in the direction of arrow H of FIG. 38.
Figure 41:
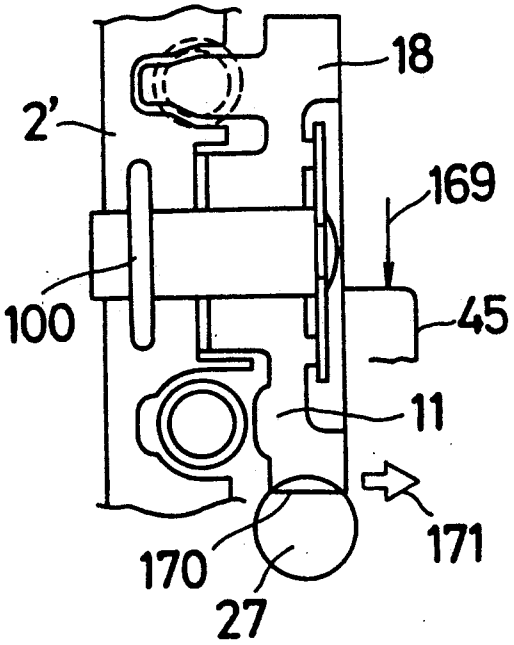
FIG. 41 is a diagram showing a component force in the direction of arrow J of FIG. 38.

In FIG. 38, arrow 167 shows the driving force applied to the wheel gear 18 from the worm gear 27, and arrow 168 shows the reaction force to the handling lever 17 from the stopper 39. Numeral 169 shows the reaction force to an end portion of the arcuate portion 45 from the arm 16. FIG. 40 is a diagram viewed from H direction, in which teeth are provided to the wheel gear 18 located at upper right of the figure. The driving power 167 applied from worm gear 27 produces a component force 171 directed to upwardly in the drawing by the slant of teeth 170 in case of teeth strip shown in the drawing. FIG. 41 is a diagram viewed from J direction of FIG. 38, in which said component force 171 either elastically transforms the resin made wheel gear in a direction of meshing where it becomes shallow with worm gear, i.e., counterclockwise in the drawing, or transforms the inserting portion of the shaft 100. However, the shallow meshing of the wheel gear with worm gear is prevented by the reaction force 169 acting on the arcuate portion 45 producing counter force counterclockwise as viewed in the drawing.

In FIG. 39, numeral 172 represents driving power given to the wheel gear 18 from the worm gear 27, numeral 173 represents reaction force to the handling lever 17 from the stopper 39, and numeral 174 represents reaction force to the arcuate portion 45 from the arm 16.

Figure 42:
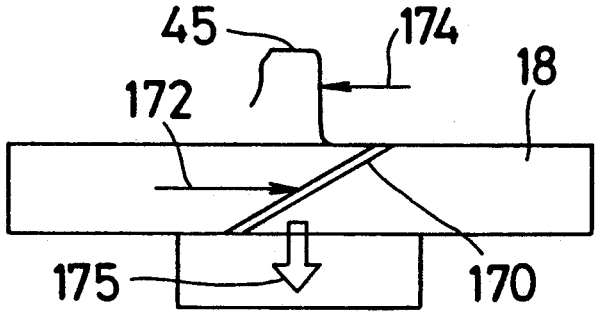
FIG. 42 is a diagram showing a component force in the direction of arrow K of FIG. 39.

FIG. 42 is a diagram viewed from K direction of FIG. 39, in which driving power 172 given from the worm gear 27 produces a component force 175 directed to downwardly in the drawing.

Figure 43:
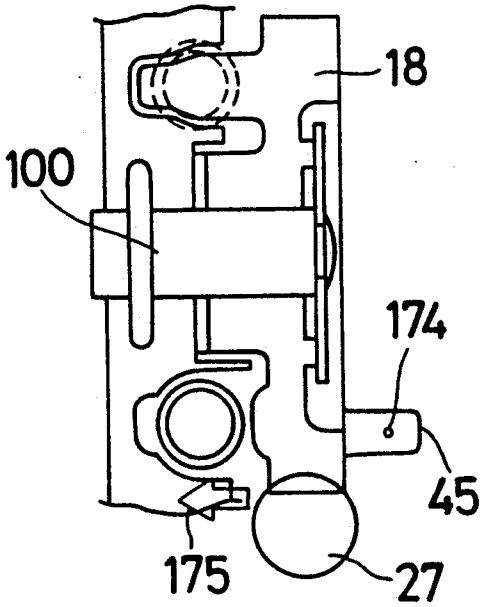
FIG. 43 is a diagram showing a component force in the direction of arrow L of FIG. 39.

FIG. 43 is a diagram viewed from L direction of FIG. 39, in which said component force 175 transforms elastically either the wheel gear or the inserting portion of shaft 100 in the direction where meshing with the worm gear becomes deep, i.e., clockwise in the drawing.

When the handling lever 17 is stopped by the stopper 39, the contact point of the arcuate portion of gear 18 with the arm 16 is located adjacent to a line connecting the worm gear 27 with the shaft 100; thus the counter force effective to prevent the meshing from becoming shallow is not produced. However, the meshing is prevented from becoming shallow by the action of said component force 175.

Figure 44:
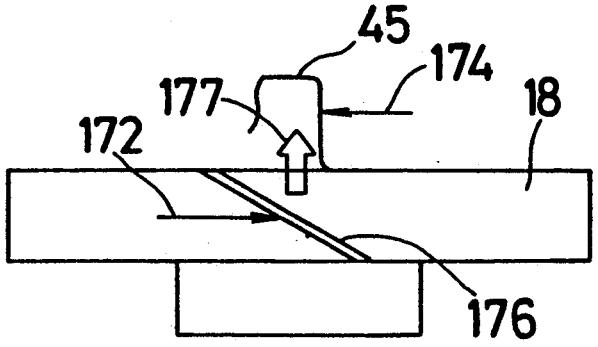
FIG. 44 is a diagram in the direction of arrow K of FIG. 39 where the teeth projections are reversed.
Figure 45:
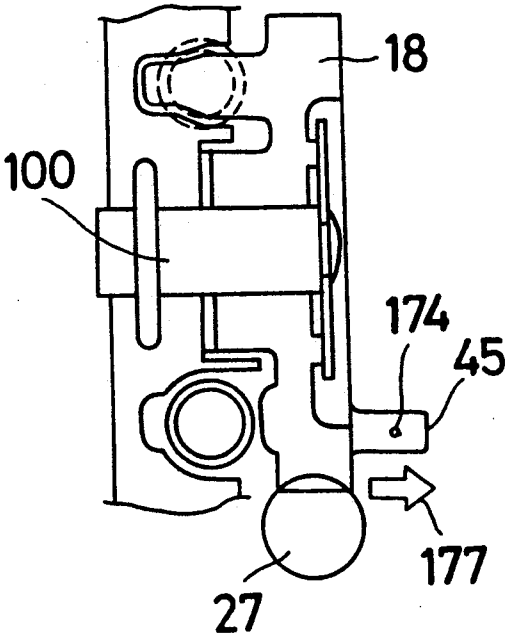
FIG. 45 is a diagram in the direction of arrow L of FIG. 39 where the teeth stalks are reversed.

FIGS. 44 and 45 show the situation where teeth 176 have the direction of teeth strip toward upper left in the drawing. The driving power 172 applied from worm gear 27 produces a component force directed upwardly in the drawing. Thus, though the component force directed upwardly causes the meshing of the worm gear with wheel gear to be shallow, and since the reaction force 174 acting on the arcuate portion 45, as aforementioned, does not produce a counter force effective to prevent that meshing from becoming shallow, for example, either the tip of the resin teeth of the wheel gear are damaged, or the tip of the teeth ride on each other and they do not to move.

Referring to the embodiment shown in FIGS. 40 and 42, a contact point of the arm 16 with arcuate portion 45 of wheel gear 18 is located adjacent the line where the location of the stopper of the handling lever 17 connects the worm gear 27 with the shaft 100, the teeth strip is determined in a direction where meshing does not become shallow by the component force produced by the driving power from the worm gear, thus freedom of position of the handling lever, the wheel gear, worm gear and the like can be obtained, and the compact power actuating means of the door lock can be realized.

Figure 46:
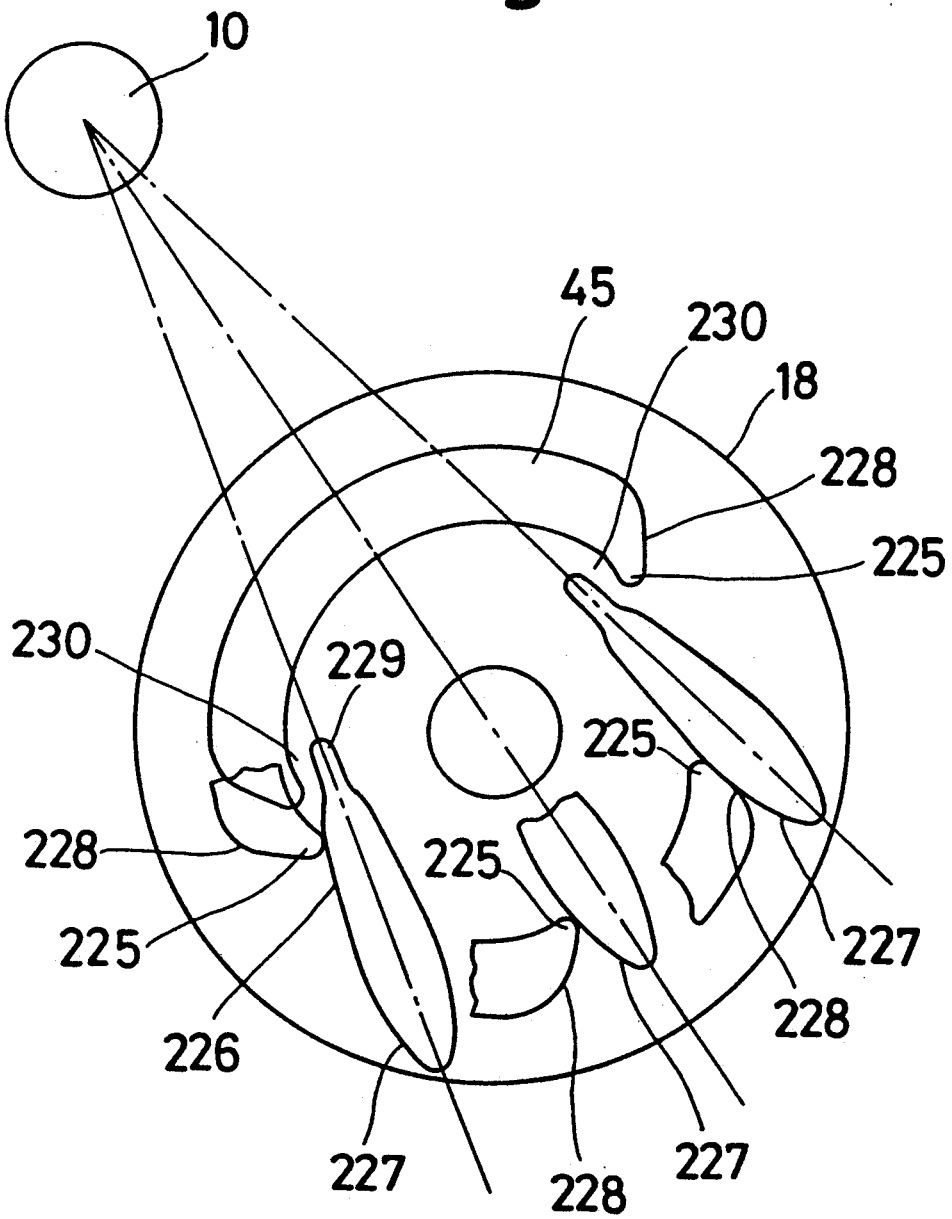
FIG. 46 is a plan view showing the relation between the operating lever and the wheel.

FIG. 46 shows another embodiment where a cam surface is provided between the arm 16 and the arcuate portion 45 of wheel gear, and the lever ratio is increased so that the output power of the output shaft 10 is increased.

Though the operating relation between the arcuate portion 45 and the arm 16 is described in FIG. 17, it is preferred that the contacting point of the arm 16 and the arcuate portion 45 of wheel gear 18 is located adjacent to the rotational center side of the wheel gear 18 as far as possible for the purpose of increasing the leverage ratio, and the contacting point of the arm 16 with the arcuate portion 45 is disposed at a location remote from the rotational center of the lever 17 as far as possible. Front end portion 225, soldered at the front end by the slender front of the arcuate portion 45 of the wheel gear 18, ran with no loading between the gap 46, is contacted by cam surface 226 of substantially an angular (Λ-shape) broadened toward the front end of the arm 16. This cam surface 226 of substantially angular shape (Λ-shape) of the arm 16 is effective to place the contacting point of the front end portion 25 of arcuate portion 45 at a location remote from the rotational center of the lever 17 as far as possible. Cam surface 226 of substantially angular shape (Λ-shape) is changed to a cam surface 227 formed slenderer that topus from the intermediate portion toward the front end. The cam surface 227 and front end portion 225 begin to contact at approximately the intermediate position of the operation of lever 17, and changing gradually to contact cam 228 formed to be a continuation of front end portion 225, and then the cam surface 228 contacts the cam surface 227 of the arm 16 at the stop position where arm 17 is stopped by the stopper 39.

Thus, cam surface 228 having a large surface is contacted at the stop position where large shock load including the rotational inertia of the motor drive operation, so that abrasion, deformation and the like can be prevented, and stable performance can also be obtained for a long period of time.

Next, a gap 230 is provided between said front end portion 225 and extended portion 229 extending toward the rotational center side of the lever 17 of said arm 16, and it is disposed to interfere with said extended portion 229 and front end portion 225 of the rotational track of the lever 17.

In the normal locking and unlocking operation, the arm 16 of lever 17 runs with empty loading between the front end portion 225 of said arcuate portion 45.

In a case where the switch for driving the motor is operated in a state where the stopper 39 is elastically transformed by loading in a direction for operating more to the locking and unlocking position, and said gap 230 is missing, and the arm 16 is entered into the rotational track of the end portion 225 of wheel gear, the front end portion 225 and the arm 16 interfere with each other so that normal operation is not carried out, and respective contacting surface is either damaged or broken.

In this embodiment, since the extended portion 229 is provided by the arm 16, even if an over load is executed, entering within the operating track of the wheel gear does not occur, and normal operation through the operation of the switch can be ensured. Further, since the arm and the arcuate portion do not interfere with each other by usual manipulation according to the setting of gap 230, the sound of resin contacting each other is not present, and a good handling feel can be obtained.

A detailed explanation of the switch for detecting a locking or unlocking by a key is hereinafter set forth. Referring to FIGS. 22, 47, 23, 48 and 49, detecting switch 205 is constituted with main body means 207 for fixing to the sub-housing 2' by screw 206 and the like, and movable means 210 for inserting an end 208 into the hole 209 of handling lever 13 and operating cooperatively with the rotational operation of key handling lever 13, and contacting point means 207A and conductive means 210A are provided in the interior (FIG. 23) as same as shown in FIG. 21, and to detect the locking and unlocking position.

Numeral 211 is a wire harness wired to the detecting switch 205. To the sub-housing 2' there is provided a space for containing said main body means 207, and holes for tightening screw 206.

Figure 57:
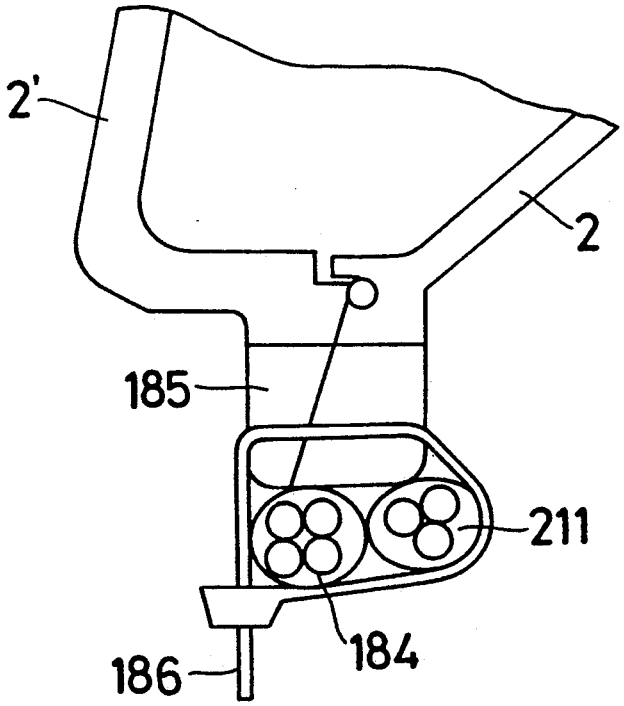
FIG. 57 is a cross sectional view of the clamping arrangement of the wire harness.
Figure 58:
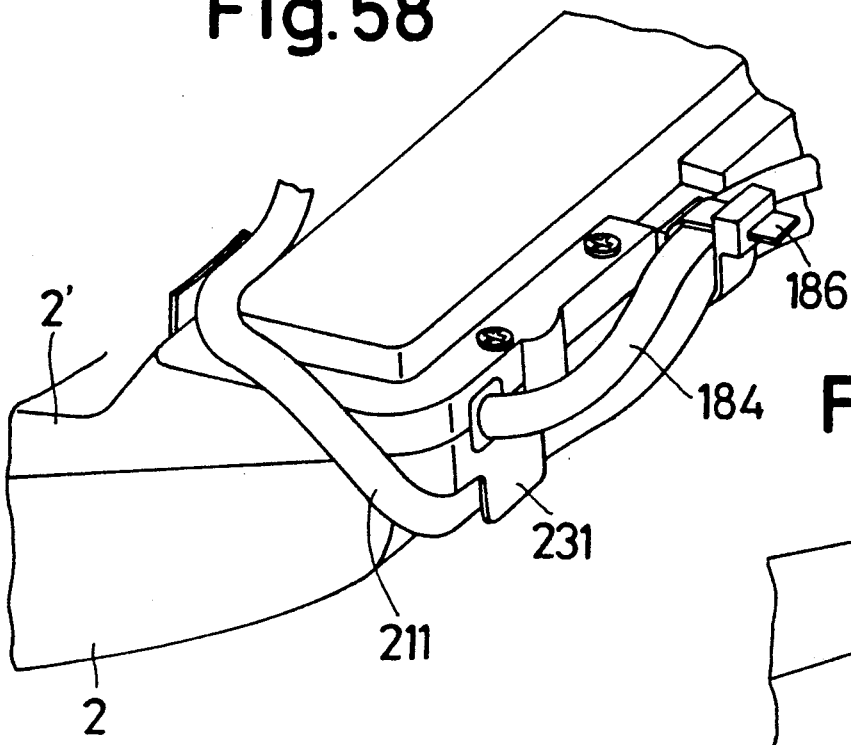
FIG. 58 is a fragmentary perspective view showing a hook of the housing.
Figure 60:
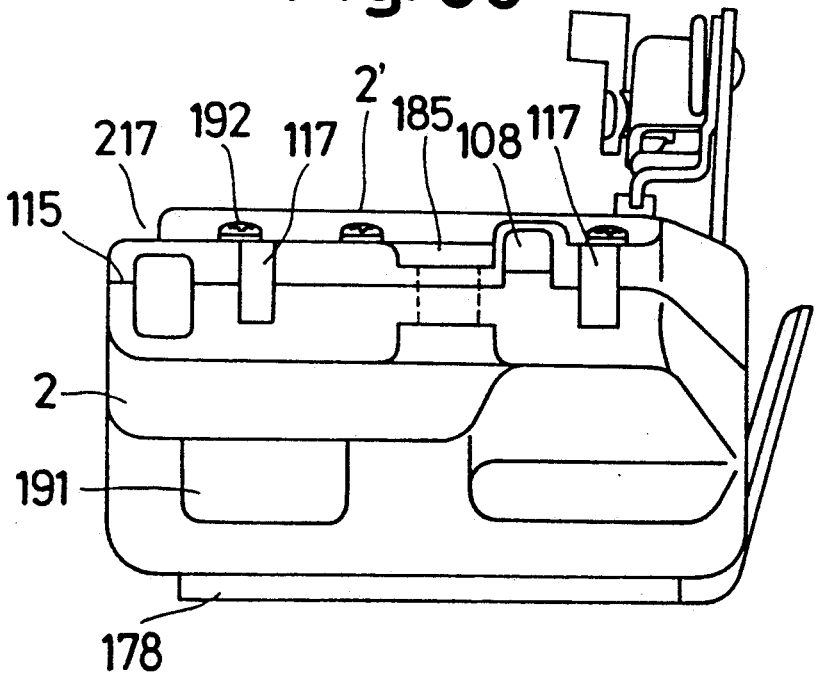
FIG. 60 is a diagram looking in the direction of arrow N of FIG. 47.

Groove 214 of substantially U-shape is formed by the walls 215 and 216 becoming a path of said wire harness 211, and it continues to the path 217 provided in the side wall. Clip 218 is mounted to said wall 215, closing the opening of groove 214 by its top end piece 219, and it prevents the wire harness 211 from springing out of groove 214. Further, FIG. 60 is a diagram viewed from arrow N of FIG. 47. Wire harness 211, as shown in FIG. 57, is fixed to the housing by clamp 186 as same as the embodiment shown in FIG. 51.

Thus, the wire harness 211 is firmly supported on the top surface of the sub-housing 2' by said clip 218 and the clamp 186, so that sufficient allowance can be given to the glass raising and lowering track 114 of FIG. 19, and essential space can be decreased, and a compact door that frees the degree of height of the lock in the vehicle can be obtained.

Figure 48:
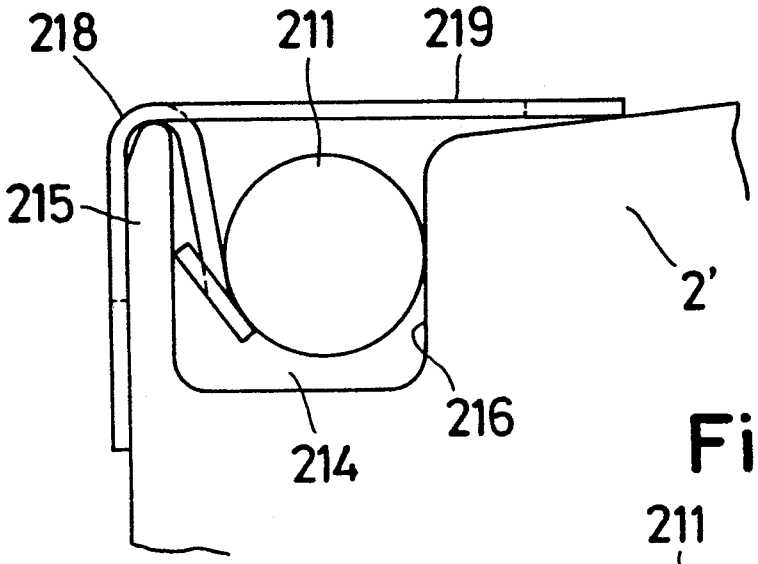
FIG. 48 is a cross sectional view showing a wire harness clip.
Figure 49:
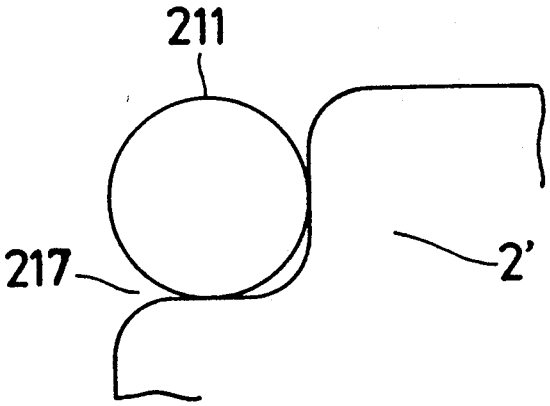
FIG. 49 is a sectional view showing a path of a wire harness.
Figure 59:
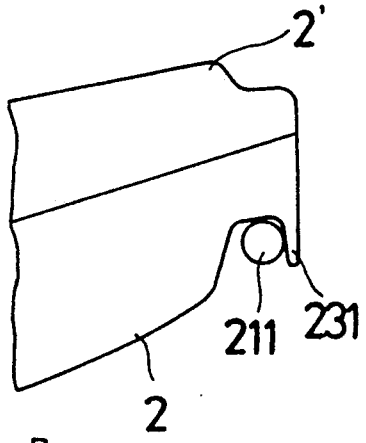
FIG. 59 is a side view showing the wire in a race.

In an article having a sufficient allowance gap for door glass raising and lowering track 114, and allowing for passing of the wire harness 211 at side surface of the housing also; wire harness 211 is mounted behind the hook 231 provided at the housing 2 as shown in FIG. 59, so that the harness is prevented from raising up freely from the surface of the sub-housing 2', and also it permits a cheaper part and assembling workability relative to the article using the clamp 186 as shown in FIGS. 22 and 48.

Figure 47:
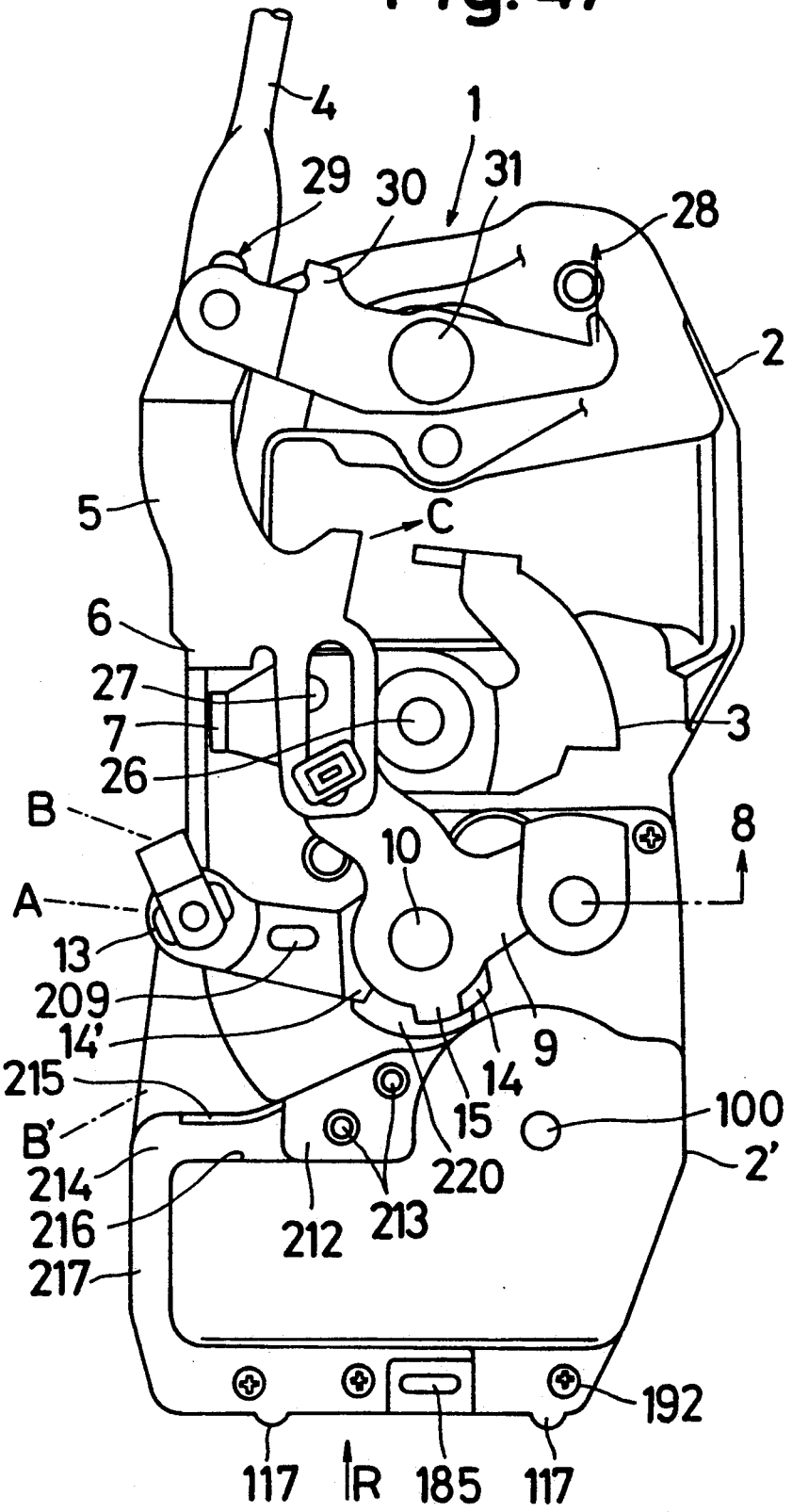
FIG. 47 is a plan view of the device of FIG. 1 showing a more detailed view of the housing assembly.

Referring to FIGS. 47, 23 and 24, the rotational operation of key handling lever 13 is transferred to the protrusion 15 of the locking arm 9 from the protrusion 14 and stepped means 14' to rotate the locking arm 9.

Switch 205 is required to be disposed closer to the door lock so as to ensure sufficient allowance with respect to the glass raising and lowering track 114 of FIG. 19.

As shown in FIG. 23, the protrusion 15 is bent to the sub-housing 2' side because said key handling lever 13 is overlaps switch 205 in the proximity of the rotational center of the locking arm 9, and recess 220 is provided within the operating range interval of protrusion in order to ensure a gap between the protrusion 15 and the sub-housing 2'. Switch 205 can be positioned closer to the door lock side by in accordance with this disposition.

Further, recess 221 is provided beneath movable or portion 210 of the switch 205, and interference between the riveted portion 222 and the locking arm 9 of output shaft 10 is prevented, so that the switch 205 can be positioned closer to the housing side.

Figure 50:
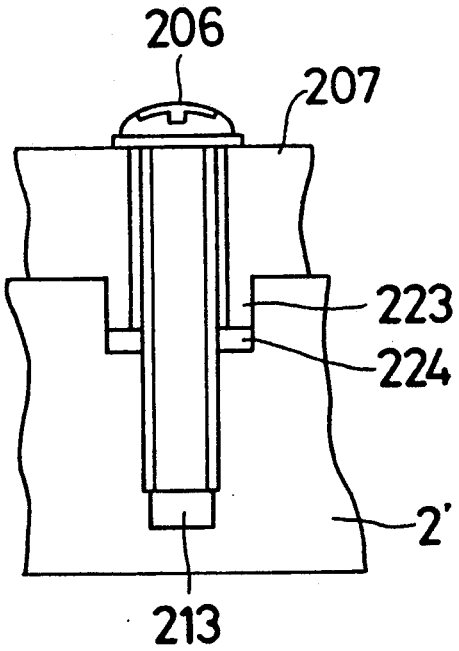
FIG. 50 is a cross sectional view of the mounting part of the switch assembly.

FIG. 50 shows the detail of coupling portion of main body 207 and sub-housing 2', in which boss means 223, which extends to the mounting surface of sub-housing 2' of main body means 207, is provided; and hole 224 for determining the location of the switch 205, is formed by inserting said boss means 223 provided at the sub-housing 2'.

Thus, the switch 205 is mounted with correct relation to one end 208 of the movable hole 209 and the hole 209 of the key handling lever 13 by the boss means 223 and the hole 224.

Figure 29:
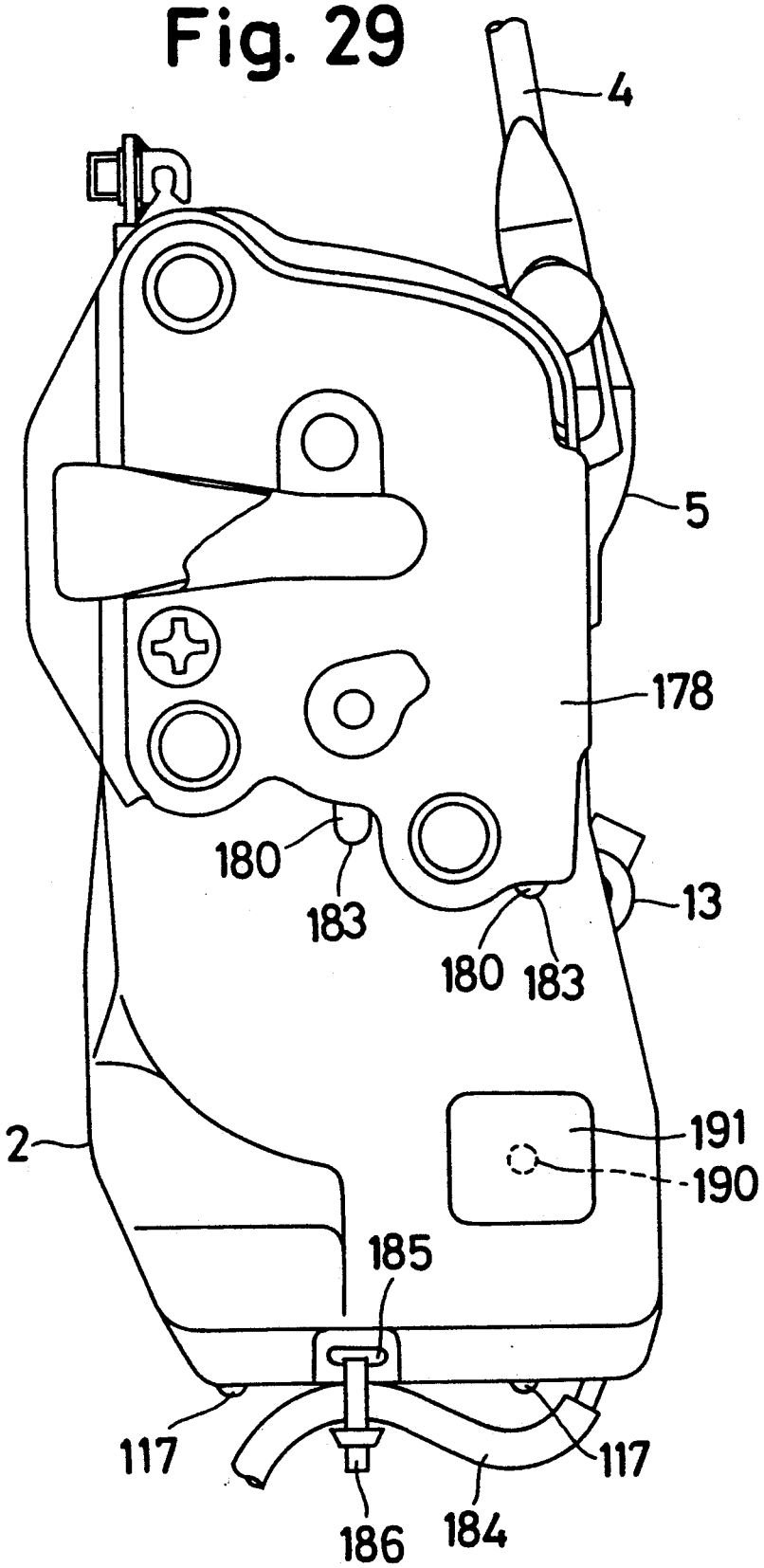
FIG. 29 is a rear plan view shown from the vehicle mounting side of the vehicle door lock.
Figure 51:
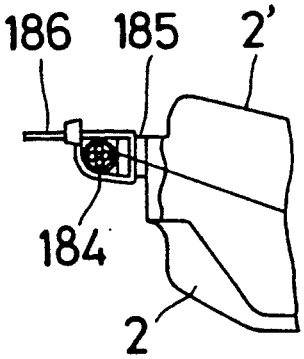
FIG. 51 is a cross sectional view of the clamp arrangement of the wire harness.

Referring to FIGS. 29 and 51, numeral 184 is wire harness wired to the motor and conductive means of base board 122, which is fixed to the housing by clamp 186 passed through the claim hole 185 provided at the housings 2 and 2'. Therefore, when mounting to the vehicle, either the connector (not shown) of the front end of wire harness is drawn and connected with connector of the other part, or the main body of the door lock is suspended by holding the connector. This tensile load is borne by said clamp 186 and does not affect any part contained within the housing. Therefore damage is not done to either the coupling portion of the motor or the coupling portion of the conductive portion of the base board; and malfunction caused by a wire cut is prevented.

Figure 52:
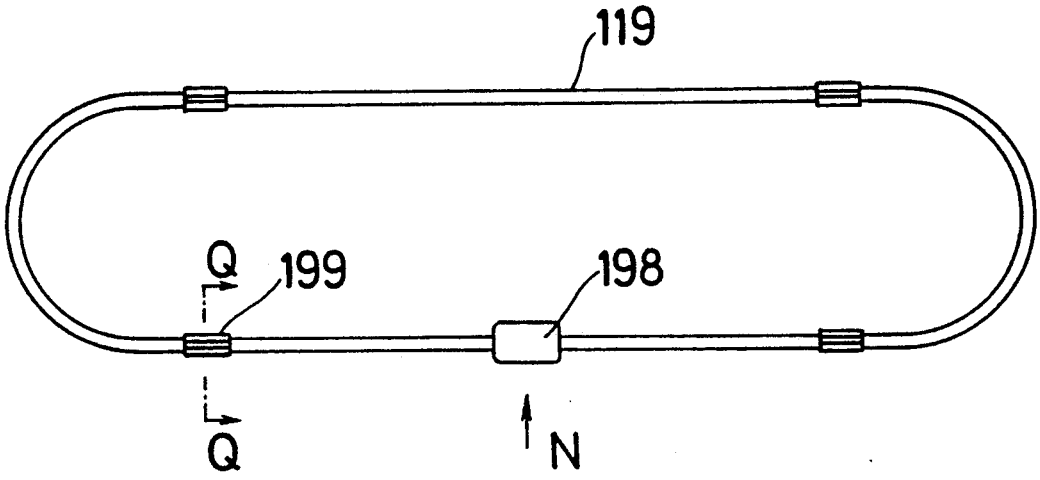
FIG. 52 is a diagram showing the "O"-ring as a whole.

FIG. 52 shows an O-ring for inserting in groove 118 of FIG. 24, in which harness holding means 198 passes through, with the wire harness disposed to conductive portion of base board of motor, and grip means 199 is provided for improving workability upon inserting in the groove 118.

Figure 53:
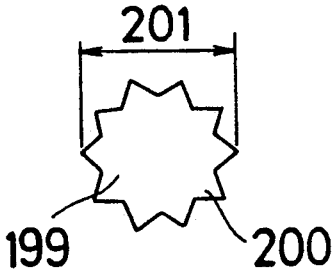
FIG. 53 is a cross sectional view taken along line Q—Q of FIG. 52.

FIG. 53 is a diagram for showing the detail of grip means 199, in which protrusions 200 are provided extending from the peripheral surface, and it has a slightly larger diameter 201 than the width of said groove 118. The groove 118 is formed in a serpentine pattern having few straight portions, as shown in FIG. 24, in order to lessen the external form of the driving means ordinarily, when inserting the O-ring in the groove 118, the O-ring springs out of the groove by the restoring force for returning to the straight state. Accordingly to workability it has been very bad.

In this embodiment, grip means 199 has larger external diameter than the groove width at several places, so that said springing out phenomenon from said groove can be prevented, and the work of inserting is greatly improved; and at the same time, insertion does not take place other than at the predetermined locations of housing 2 and 2', preventing damage to the sealing capability, and the deteriorating of function of the driving means by the intrusion of water or dust and the like, into the interior of housing.

Figure 54:
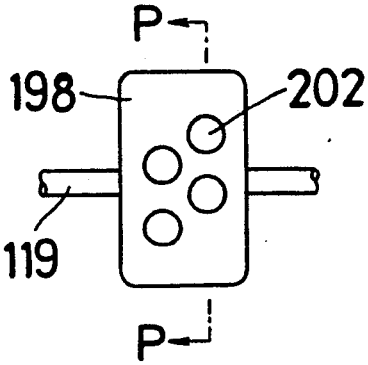
FIG. 54 is a diagram looking in the direction of arrow N of FIG. 52.
Figure 55:
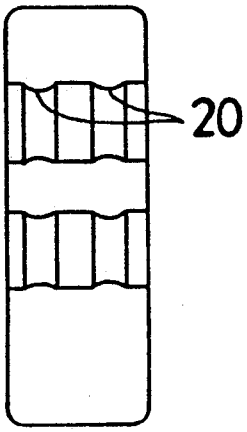
FIG. 55 is a diagram taken in the direction of arrow P of FIG. 54.

FIG. 54 is a diagram viewed from N direction of FIG. 52, in which hole 202 for passing through the wire harness is provided. FIG. 55 is cross sectional view taken at line P—P of FIG. 54, in which a convexed portion 203 is established with a smaller diameter than the external diameter of the harness within the hole 202.

Figure 56:
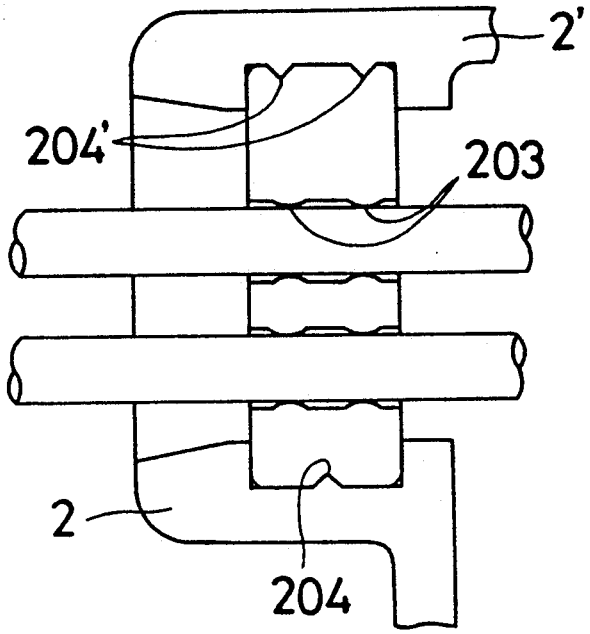
FIG. 56 is a cross sectional view of the supporting assembly of the wire harness.

FIG. 56 is a diagram showing a state where harness holding means 198 is fixed to the housings 2 and 2', in which projections 204, 204' are provided at the housings 2 and 2', and they press the harness holding means 198.

Intrusion of rain water or dust is prevented by the projecting portions 203 placed between the harness and the hole 202, and by projecting portions 204, 204' placed between the harness holding means 198 and the housing 2 and 2'. Further, projecting portions 203 has the function of limiting the movement of the harness, and it executes the stopping of mis-matching in case that load is applied to the front end of the harness.

It will be apparent to those skilled in the art, that various modifications and variations can be made in the present invention without departing from the spirit or scope of the invention. Thus, it is intended that the present invention cover the modifications and variations provided they come within the scope of the appended claims and their equivalents.

What is claimed is:

1. A power operated door lock device, comprising:

a housing:

a locking arm mounted to the housing and movable between a normal and a locking and unlocking position;

an actuator assembly, including a gear wheel assembly mounted to the housing said gear wheel assembly including a gear wheel having peripheral teeth and opposite first and second planar surfaces, the first planar surface having an arcuate groove substantially concentric to the perimeter extending through a predetermined angular segment of the gear wheel;

an elongate coil spring longitudinally disposed in the groove and compressible longitudinally in opposite directions within the groove;

a convex raised abutment surface disposed on the second planar surface of the gear wheel, adjacent the periphery of the gear wheel, having opposite ends and defining a segment of the gear wheel;

a pivotally mounted handling lever having an end portion engageable by the opposite ends of the convex abutment for driving the locking arm selectively in opposite direction to the locking and unlocking position in response to a corresponding rotation of the gear wheel;

drive means when energized operative to rotate the gear wheel from a normal position in opposite directions to an unlocking and locking position; and means responsive to the rotation of the gear wheel for compressing the elongate spring longitudinally in the direction of rotation of the wheel for returning the wheel to the normal position upon deenergization of the drive means.

2. The door lock device of claim 1 further comprising switch means including a contact portion fixedly mounted to the housing and a contacting portion on the handling lever for sliding into and out of engagement with the contact portion indicating the locking and unlocking position of the handling lever.

3. The door lock device of claim 1 wherein the opposite ends of the raised convex abutment formed on the second planar surface of the wheel and the engaging portion on the end of the handling lever are configured to provide an initial engagement in the form of point contact with each other and continued engagement in the form of surface contact with each other.

4. The door lock device of claim 1 further comprising resiliently deformable elastic stopper members disposed spaced from the gear wheel adjacent the locking and unlocking positions to limit rotation of the handling lever.

5. The door lock device of claim 1 wherein the drive means is a motor driven worm gear in meshing engagement with the teeth of the gear wheel.

6. The door lock device of claim 1 wherein the arcuate groove is a groove adjacent the periphery of the gear wheel extending completely about the periphery of the wheel, and further comprises a portion of reduced width to support opposite ends of the coil spring.

* * * * *